US007992243B2

(12) United States Patent
Cook et al.

(10) Patent No.: US 7,992,243 B2
(45) Date of Patent: Aug. 9, 2011

(54) CUSTOM FIT SYSTEM WITH ADJUSTABLE LAST AND METHOD FOR CUSTOM FITTING ATHLETIC SHOES

(75) Inventors: Christopher S. Cook, Portland, OR (US); Bruce J. Kilgore, Lake Oswego, OR (US); James C. Meschter, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 12/838,965

(22) Filed: Jul. 19, 2010

(65) Prior Publication Data

US 2010/0275392 A1 Nov. 4, 2010

Related U.S. Application Data

(60) Division of application No. 11/867,007, filed on Oct. 4, 2007, now Pat. No. 7,757,325, which is a continuation of application No. 11/202,657, filed on Aug. 12, 2005, now Pat. No. 7,287,293.

(51) Int. Cl.
*A43D 00/00* (2006.01)

(52) U.S. Cl. ..... 12/142 R; 12/146 C; 12/146 M

(58) Field of Classification Search ..... 12/142 R, 12/145, 142 E, 146 D, 133 R, 146 C, 146 M
See application file for complete search history.

(56) References Cited

U.S. PATENT DOCUMENTS 1,510,286 A * 9/1924 McMonagle ..... 12/124
1,691,054 A 11/1928 Galterio
1,746,466 A 2/1930 Galterio
1,753,857 A 4/1930 Galterio at al.
1,817,639 A 8/1931 Moskow
2,443,792 A 6/1948 King
2,450,490 A 10/1948 Shinberg et al.
2,488,720 A 11/1949 Galterio
2,549,502 A 4/1951 McClenathan
2,582,298 A 1/1952 Ushakoff et al.
2,597,197 A * 5/1952 Stacey ..... 12/53.6
2,634,439 A 4/1953 Fitzpatrick
2,689,365 A 9/1954 Koskela
2,714,217 A 8/1955 Dore
3,032,792 A * 5/1962 Frank ..... 12/53.6
3,744,073 A * 7/1973 Nelson et al. ..... 12/1 A
3,860,986 A 1/1975 Ballard
(Continued)

OTHER PUBLICATIONS

Office Action mailed Nov. 30, 2010 in U.S. Appl. No. 12/837,955.

(Continued)

*Primary Examiner* — Marie Patterson
(74) *Attorney, Agent, or Firm* — Plumsea Law Group, LLC

(57) ABSTRACT

A system for custom fitting athletic shoes to an individual wearer includes a foot measurement device, an adjustable footform and an infrared activation chamber. Shoes of a single width for each length size have at least a portion of the upper made of heat malleable material to be custom fitted for width. Foot measurement data is used to calculate length size, width size and a number of custom adjustment factors. After the length size is calculated, the appropriately sized shoe and last are assembled together and subject to infrared radiation until the heat malleable material becomes plastic. Adjustments are then made to the last in accordance with the adjustment factors to provide custom width sizing. After further heat treatment to set the shoe upper and cooling, the shoe is complete. In this manner, if used in a retail setting, shoes are custom fitted to the wearer in a matter of minutes.

60 Claims, 31 Drawing Sheets

U.S. PATENT DOCUMENTS 3,977,034 A * 8/1976 Brown ..... 12/142 R
4,060,869 A 12/1977 Brown
4,275,512 A * 6/1981 Zeligman et al. ..... 36/11.5
4,512,052 A 4/1985 Bruno
4,594,283 A 6/1986 Ohigashi
5,067,257 A 11/1991 Coomer
5,084,332 A 1/1992 Burgess
5,123,169 A 6/1992 White et al.
5,128,880 A 7/1992 White
5,231,723 A 8/1993 White et al.
5,237,520 A 8/1993 White
5,339,252 A * 8/1994 White et al. ..... 700/98
5,373,596 A 12/1994 Harrell
5,714,098 A * 2/1998 Potter ..... 264/40.1
5,718,013 A 2/1998 Gumbert
5,729,912 A 3/1998 Gutkowski et al.
5,732,428 A 3/1998 Brown
5,813,146 A 9/1998 Gutkowski et al.
5,875,504 A 3/1999 Tambling
5,909,719 A 6/1999 Throneburg et al.
6,299,817 B1 * 10/2001 Parkinson ..... 264/402
6,558,784 B1 5/2003 Norton et al.
6,834,437 B1 12/2004 Kilgore et al.
6,879,945 B1 4/2005 Cook
6,920,707 B1 7/2005 Greene et al.
6,983,548 B1 1/2006 Cook et al.
7,016,867 B2 3/2006 Lyden
7,153,457 B2 12/2006 Shor
7,287,293 B2 10/2007 Cook et al.
7,316,083 B2 1/2008 Labonte
7,627,963 B2 12/2009 Kilgore
7,757,325 B2 7/2010 Cook et al.
2002/0088145 A1 7/2002 Clark et al.
2003/0041394 A1 3/2003 Tak
2003/0069807 A1 4/2003 Lyden
2004/0024645 A1 2/2004 Potter et al.
2005/0071242 A1 3/2005 Allen et al.
2005/0257405 A1 11/2005 Kilgore
2008/0000109 A1 1/2008 Challande

OTHER PUBLICATIONS

Response to Office Action filed Feb. 14, 2011 in U.S. Appl. No. 12/837,955.

* cited by examiner

CUSTOM FIT SYSTEM WITH ADJUSTABLE LAST AND METHOD FOR CUSTOM FITTING ATHLETIC SHOES

CROSS-REFERENCE TO RELATED APPLICATIONS

This application is a divisional of co-pending application Ser. No. 11/867,007, filed Oct. 4, 2007, which is a continuation of application Ser. No. 11/202,657 filed Aug. 12, 2005, now U.S. Pat. No. 7,287,293.

BACKGROUND OF THE INVENTION

1. Field of the Invention

The present invention relates to a system and method for custom fitting athletic shoes to wearers by measuring the feet, correlating the foot measurements to settings on an adjustable last, fitting an appropriately sized shoe with heat malleable activation zones on the adjustable last and heat-treating the shoe while adjusting the last to customize the fit of the shoe to the wearer.

2. Background of the Invention

The athletic shoe industry continues to research ways to improve the fit of athletic shoes, and to customize the fit to an individual wearer. The oldest way of custom fitting shoes to an individual wearer is to make the shoes based on a customized last for the particular individual's feet. This is tantamount to custom tailored or bespoke clothing, and involves an expensive and time consuming process. Numerous attempts have been made to try to bring a custom fit to the mass produced market for footwear.

One of the obstacles to customizing the fit of mass produced shoes in the past has been the fact that the component which has the primary influence on fit, the shape of the last on which the footwear is formed, has remained unchanged. In general a last or form is made by taking the following foot measurements into account: the overall length of the foot, the width of the foot, the height of the first digit, the contour of the instep, and at least six girth measurements. The general practice is to shape a last for mass production by utilizing foot measurements from a broad spectrum of the population to determine the characteristics of a statistically average foot. This will theoretically achieve a proper fit for a majority of the population. Footwear sizing is generally based on the overall length of a wearer's foot with accommodation made for the width or girth of the foot. Most footwear manufacturers only provide consumers with footwear in limited length-width combinations.

Prohibitive manufacturing and retail inventory challenges prevent mass manufacturers and marketers from offering footwear sizes in a full spectrum of length-width combinations. Since each length-width combination for an article of footwear generally requires a unique last that is correctly proportioned for that particular length-width combination, economics generally forces manufacturers and retailers to offer a limited spectrum of length-width combinations, based again, on a statistically average foot. The attempt is to cover as large a cross section of the population as possible. Research has demonstrated that this approach, while cost effective, has drawbacks to the consumer. Traditionally manufacturers use the same tooling for different widths, only the upper is differently sized in width.

Many individuals do not have feet with statistically average proportions so the usual length-width combinations would not provide a proper fit. Some people have feet of left and right feet of different widths, such as the dominant foot being slightly larger. Any of these factors necessitate fit adjustment to enable the wearer to receive the full benefit of an athletic shoe in particular.

One way of providing a custom fit is described in commonly assigned U.S. application Ser. No. 10/099,685 filed on Mar. 14, 2002, which is hereby incorporated by reference. The '685 application describes a method by which a wearer can purchase footwear through a remote communication channel by specifying the last that is used to construct the footwear. The wearer can identify a last based on previous experience with footwear that was constructed using that last. The last may be specified by a model number and size, or by employing measurements of the wearer's foot to determine the last which is used to construct the footwear.

Shoes have been made with a variety of adjustment mechanisms such as fastening systems, differing materials and the like, but mass produced shoes generally are still made with predetermined lasts or forms. Little has been done to customize the fit of mass produced shoes by adjusting the lasts themselves. Since the shoe is completed during manufacturing, even if any adjustments were made in the past, they would have to be performed during manufacture, thus delaying greatly the receipt of customized shoes by the wearer.

Prior attempts to customize the fit of athletic shoes have resulted in many solutions which all require the wearer to wait for the customized shoes. There exists a need for a retailer to provide a customized fit after manufacture of the shoe, preferably at the point of sale.

SUMMARY

The present invention addresses the need for customizing the fit of shoes by using the measurements of an individual wearer's feet instead of statistically average feet. An aspect of the invention is to provide for measurement of the feet and completion of the shoe at a single location, such as a retail store. Another aspect of the invention is to provide for measurement of feet at one location and completion of the shoes at another location. For example, measurement is taken at a retail location or other location, the measurements transmitted to a manufacturing or distribution location for completion of the shoes. Footwear to be customized is produced with at least a portion of the shoe upper constructed of material that can exhibit plastic properties which can be set using an adjustable last. The shoe sole unit is also configured to provide for width adjustment. One advantage of the present invention is that retailers would only have to carry inventory in multiple lengths as the present invention allows precise width fitting for each customer with inventory of only one shoe per length size.

The custom fit system of the present invention comprises a measurement device for measuring a wearer's foot, an adjustable last for each length size of shoe, and an infrared activation chamber with controls. The system also comprises a specially constructed shoe with activation zones which are designed to heat-set to size in the infrared activation chamber. The system optionally comprises a cooling apparatus for providing cooling treatment to the heat-set shoes.

The measurement device may be as simple as a ruled measurement tool, or as complex as a three-dimensional laser scanner. One common ruled measurement device is the Brannock™ device which provides linear toe-to-heel, heel-to-ball and width measurements for each foot. The Brannock size may be used as the sizing system for the present invention. Alternatively, a shoe size can be calculated from the foot measurements obtained from a scan of the wearer's feet.

The adjustable last comprises a foot form having adjustable width and instep portions which can be moved to provide narrower, skinnier, wider and/or thicker forms to mirror the dimensions of a wearer's foot. These movable portions are connected to appropriate calibrating mechanisms for adjusting the movable portions. The adjustable last system includes a sizing algorithm that converts specific data taken from a customer's foot measurements into precise numerical settings of the calibrating mechanisms of the adjustable last.

Once the length sizes of the wearer's feet are determined, correspondingly length-sized shoes with specially designed uppers constructed at least in part of heat treatable material are selected for customization. Width adjustment of the sole unit of the shoe may be accomplished by using an adjustable midsole unit with replaceable midsole plugs. Alternatively, sole units of different widths without plugs may be used to customize the width. The outsole may have a longitudinal split to accommodate the adjusted wider or narrower width of the midsole. In a preferred embodiment, replaceable midsole plugs are used, and the appropriately sized midsole plug is inserted into the midsole.

The adjustable last is then inserted into the shoe, the shoe and last are heat treated in the infrared activation chamber, and the last is adjusted when the heat malleable materials become plastic to stretch the shoe to the adjusted last. The adjusted last and shoe are further treated to set the upper. The last and shoe are cooled either by resting at room temperature or in an optional cooling apparatus. After the activation zones of the shoe are set, the last is removed. The custom fit steps are completed, and the shoe can then be tried on for fit. If further adjustment is necessary, additional heat treatments with corresponding last adjustments are possible.

The activation chamber comprises multiple infrared lamps covered by protective shields to the outside. The lamps are positioned around a target area in which the shoe can be placed. The lamps are coupled to a controller which controls the temperature, speed of heating and the duration that the lamps expose the shoe to infrared radiation. The controller may be subsumed in a computer that controls the entire process. For convenience of description, the infrared activation chamber is sometimes referred to as an IR heater with the understanding that the "heat" applied is infrared radiation. It is to be understood that infrared radiation treatment is also referred to as "heat" treatment in a broad sense.

Although infrared radiation is preferred, other forms of energy may be used in the activation chamber with correspondingly selected and designed materials in the activation zones of the shoe upper. The alternative forms of energy include, but are not limited to, microwave radiation, sonic, laser, electrical or electro-magnetism.

Other configurations, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings.

DETAILED DESCRIPTION

Figure 1:
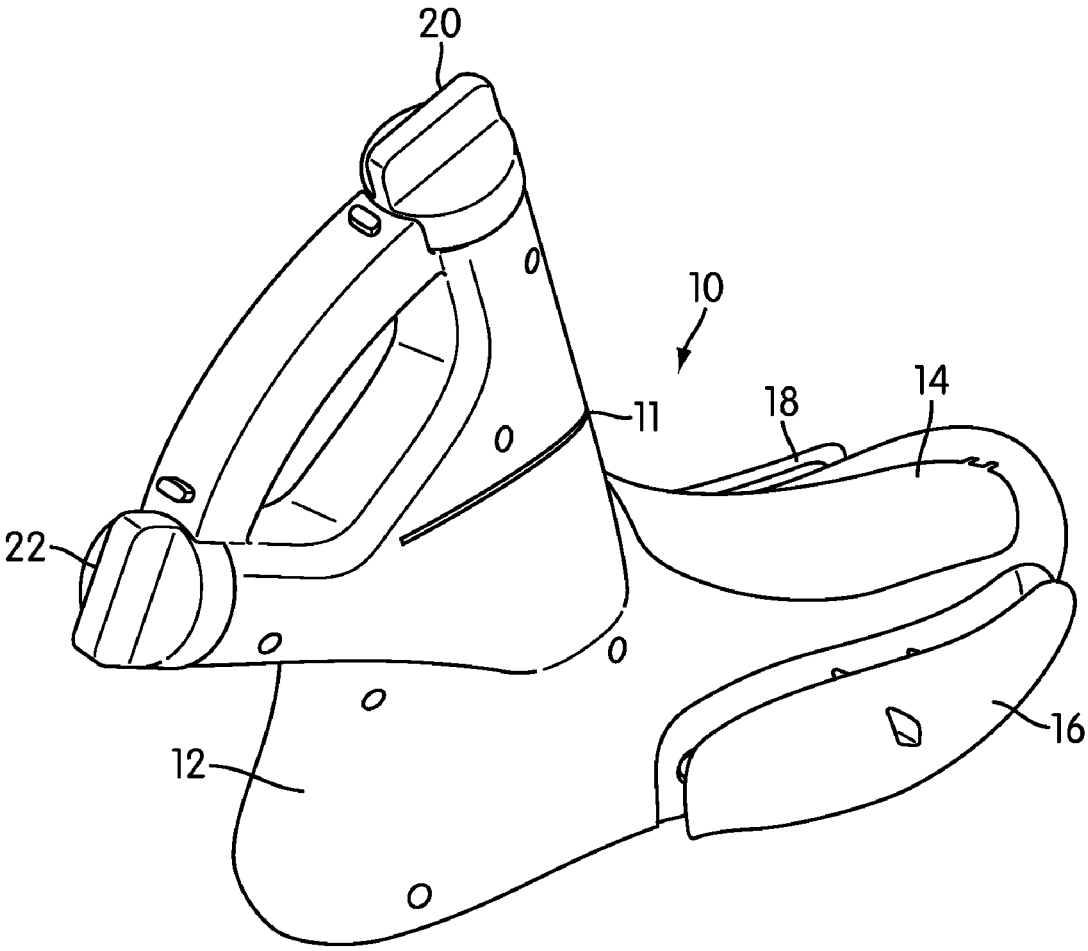
FIG. 1 is a perspective view of an adjustable shoe last in accordance with the present invention.
Figure 2:
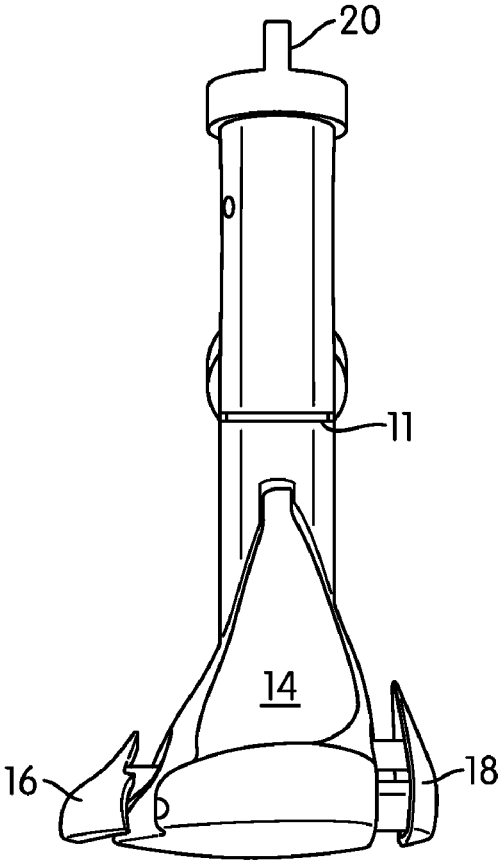
FIG. 2 is a front elevational view of the adjustable shoe last shown in FIG. 1.
Figure 3:
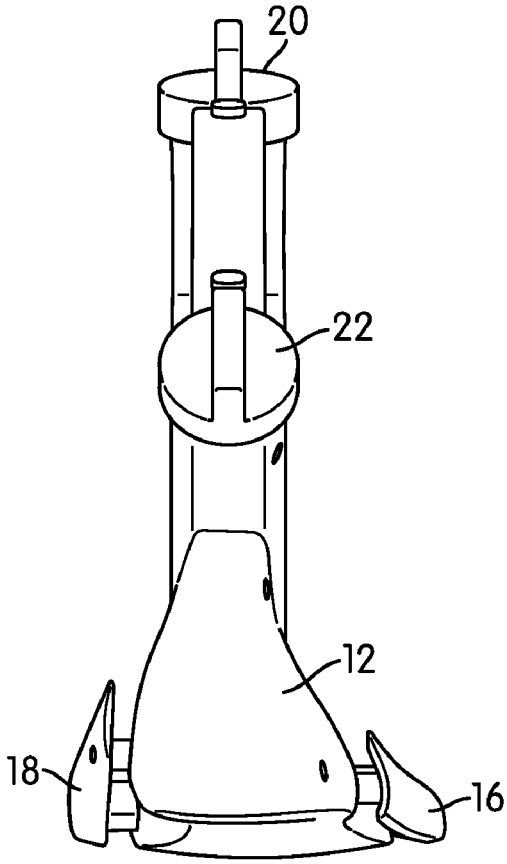
FIG. 3 is a rear elevational view of the adjustable shoe last shown in FIG. 1.

An adjustable last 10 in accordance with the present invention is shown in detail in FIGS. 1-8*g*. Last 10 has a main body portion or chassis 12, in step mushroom 14, lateral mushroom 16, medial mushroom 18, and at least two adjustment dials. Last chassis 12 includes a detent 11 along the front of the ankle area for engaging with a detection mechanism of the system. Instep dial 20 controls the position of instep mushroom 14, and width dial 22 controls the position of lateral and medial mushrooms 16 and 18. Each of the dials is equipped with a button knob release 21. Each last 10 is of a specified length size, and the mushrooms allow for varying width sizes via movement of the lateral and medial mushrooms, and varying girth sizes via movement of the instep mushroom. The lateral and medial mushrooms move upon movement of the width dial. Adjustment of the last in relation to measurements of a wearer's foot provides a customized fit once the shoe is heat treated until the heat malleable materials in the activation zones are plastic, and the last adjusted to set the shoe size.

Figure 4A:
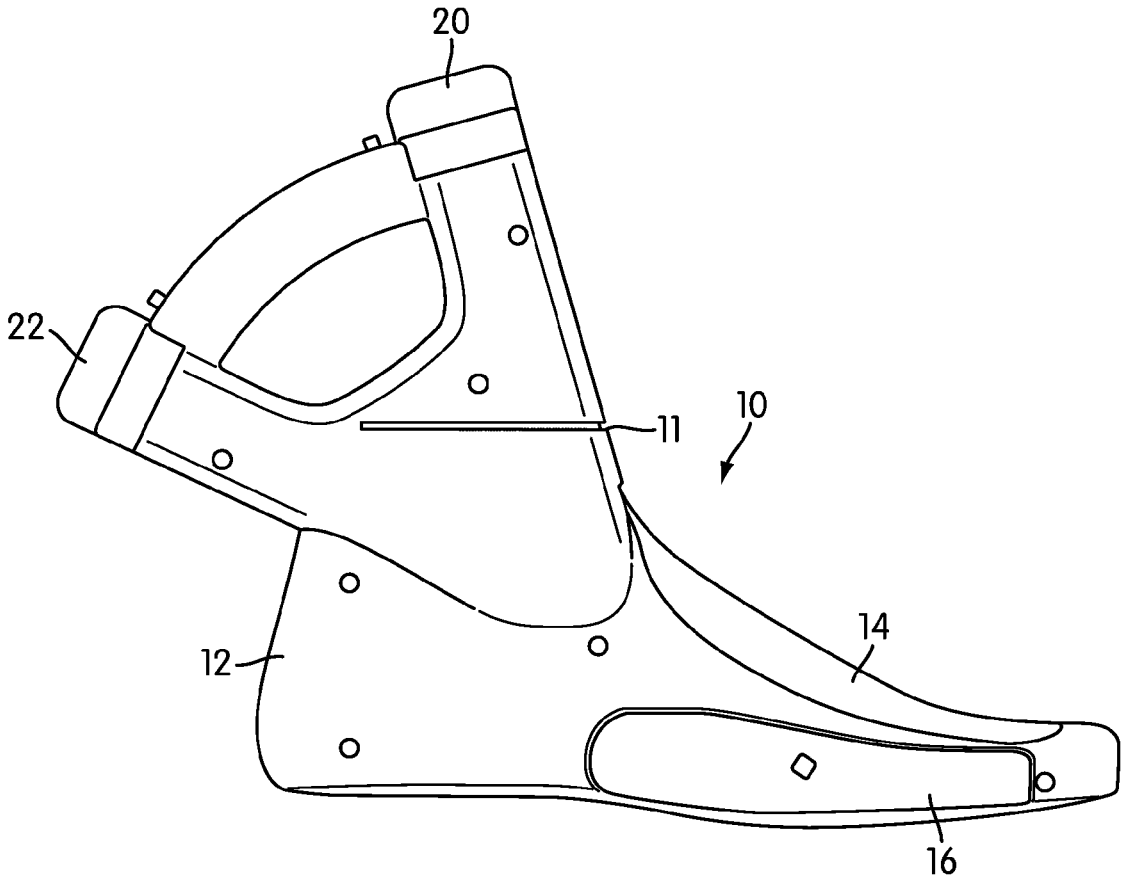
FIG. 4*a* is a lateral side elevational view of the adjustable shoe last shown in FIG. 1.
Figure 4B:
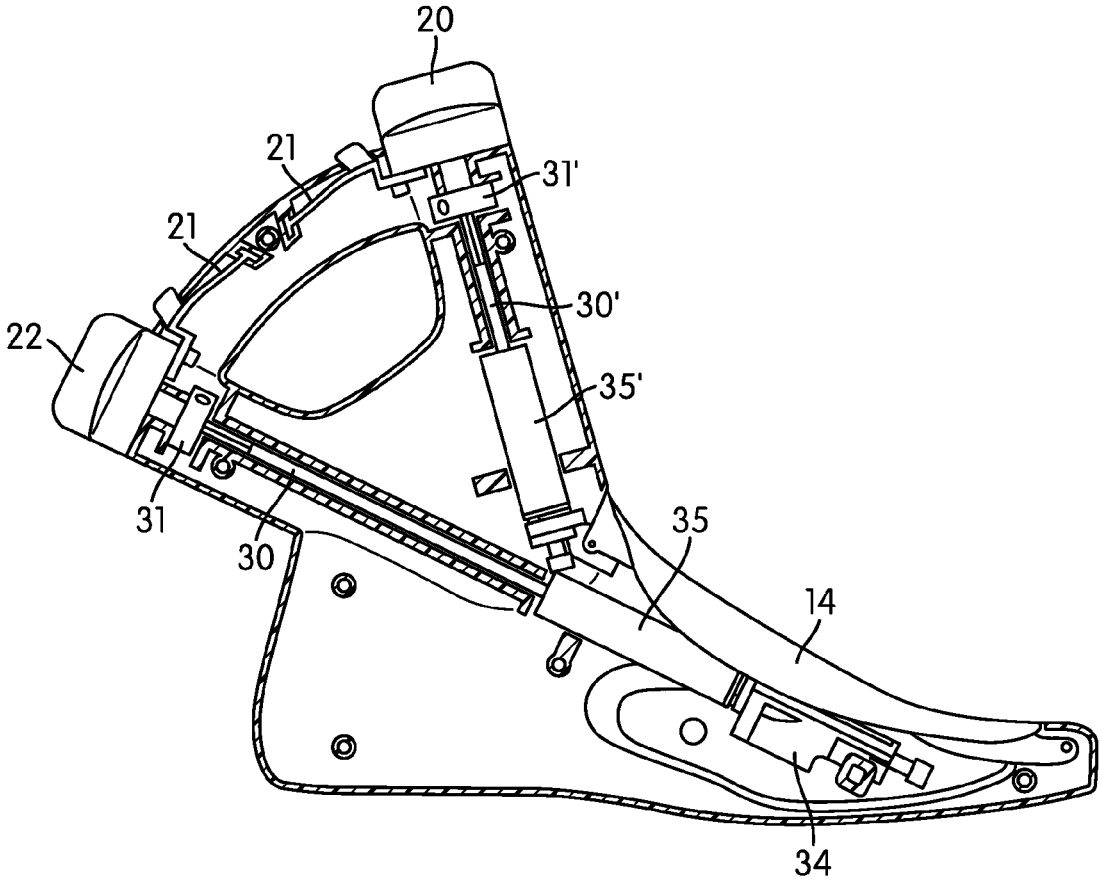
FIG. 4*b* is a side view of the internal components of the adjustable shoe last.
Figure 4C:
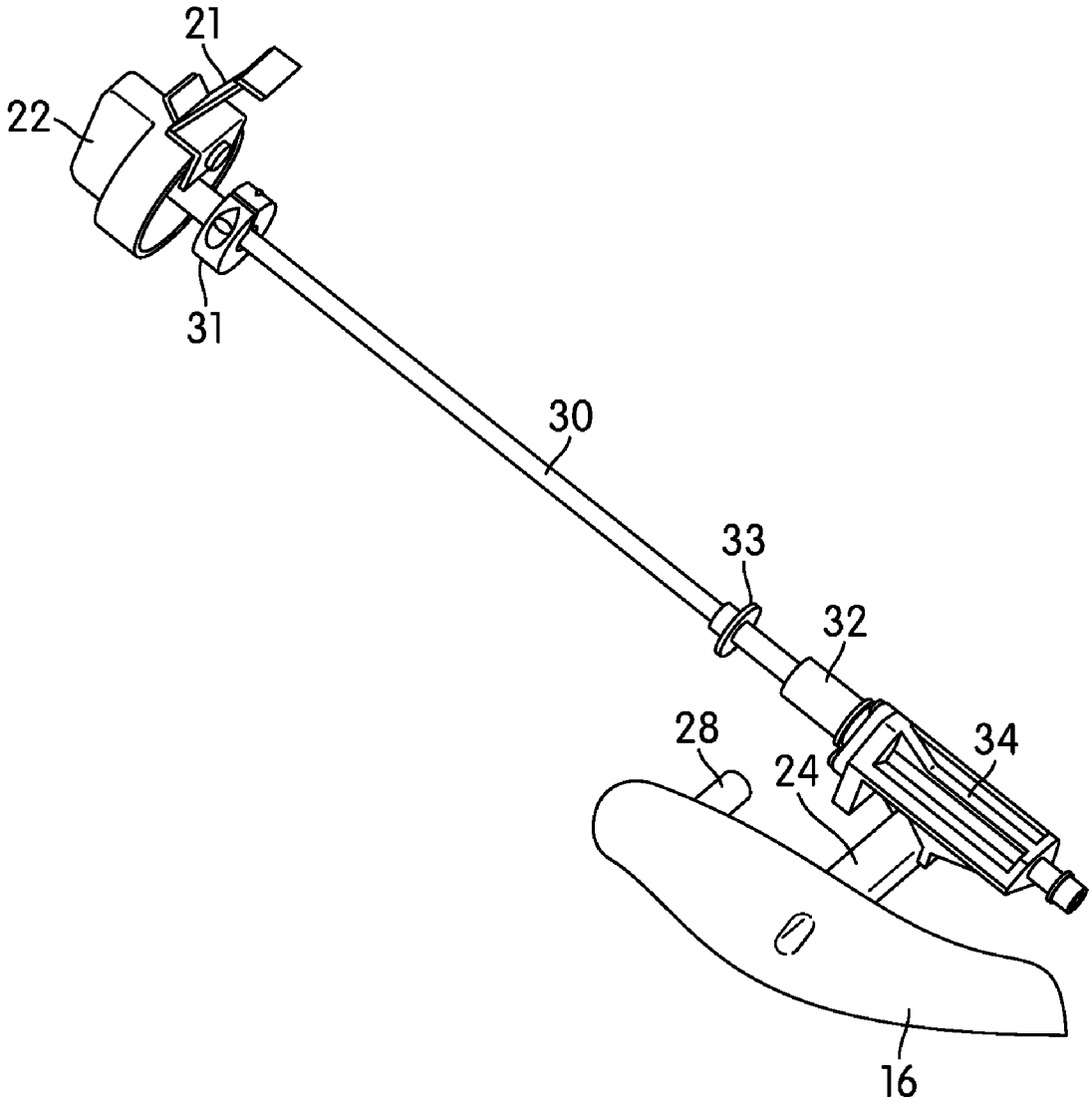
FIG. 4*c* is a perspective assembly view of the lateral width mushroom adjustment mechanism of the adjustable shoe last.
Figure 4D:
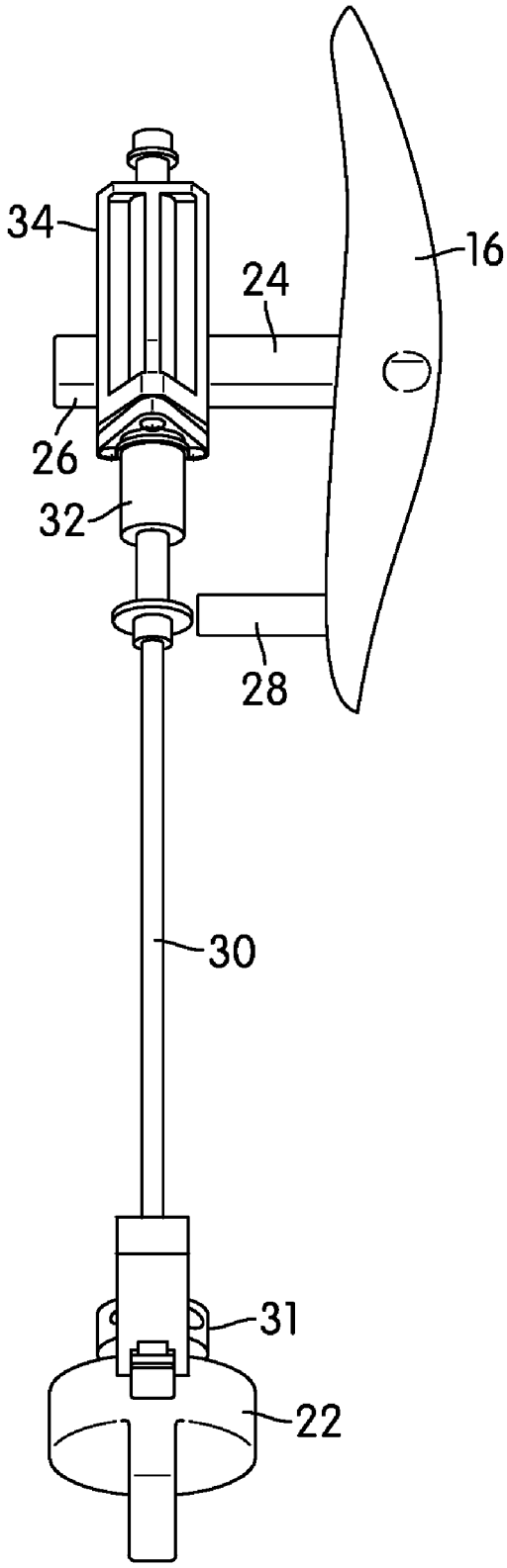
FIG. 4*d* is a top plan view of the lateral width mushroom adjustment mechanism.
Figure 4E:
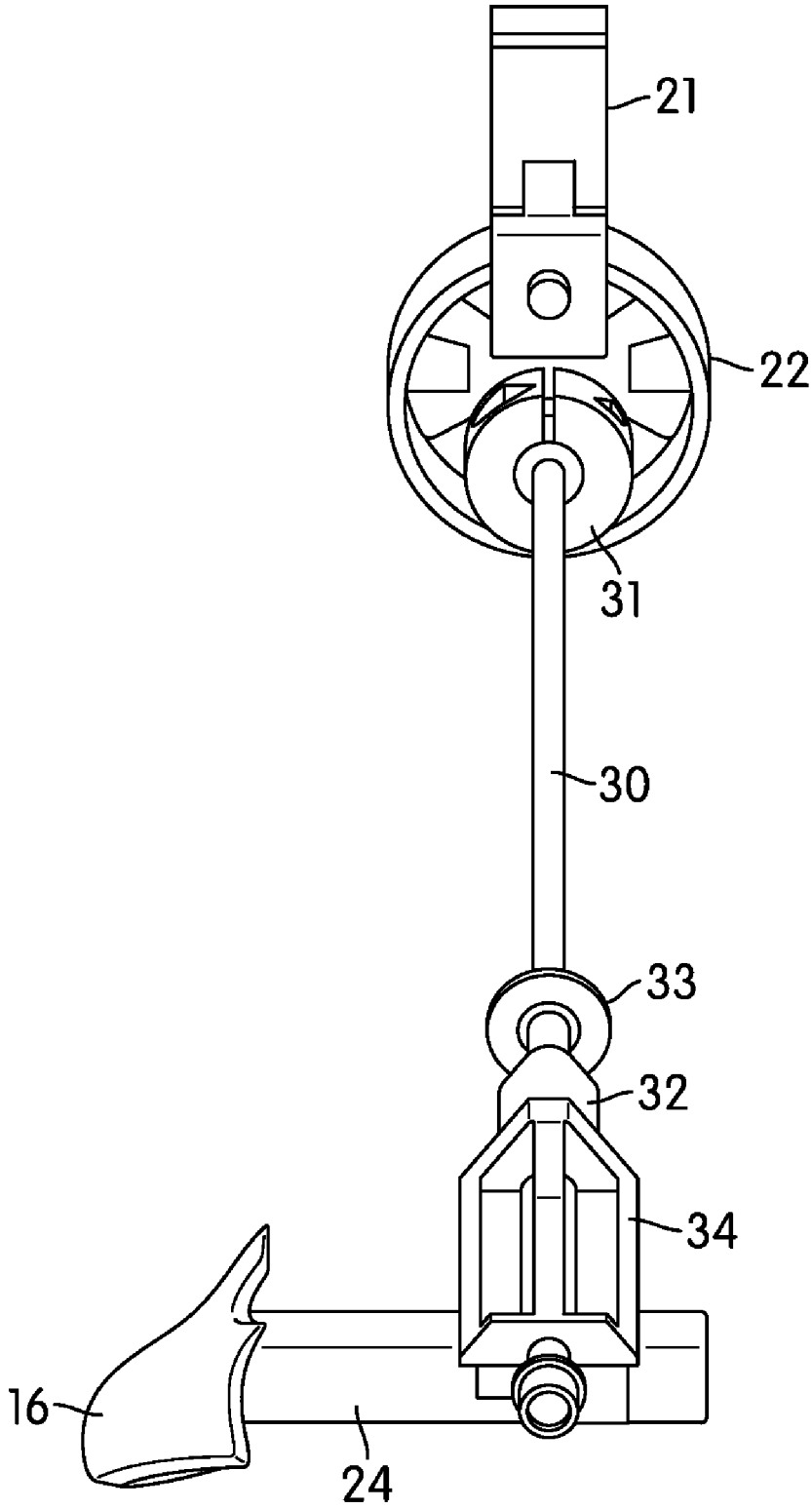
FIG. 4*e* is a front elevational view of the lateral width mushroom adjustment mechanism.

The internal mechanisms of the adjustable last are shown in FIGS. 4*b*-4*f*. The adjustment mechanism for lateral mushroom 16 will be discussed in detail. It will be understood that the mechanism for the medial and instep mushrooms operate similarly. Referring to FIGS. 8*a*-8*f*, lateral mushroom 16 is shown in isolation. The internal side of mushroom 16 has a driving post 24 extending inward with an angled notch 26 formed therein. Mushroom 16 also has a guide post 28 extending inward and spaced away from driving post 24. Guide post 28 is received in a guide hole on the last to ensure alignment of mushroom 16 with respect to the body of the last. Referring to FIGS. 4*b*-4*e* and FIGS. 8*a*-8*f*, dial 22 drives a threaded lead screw 30 which is coupled to a nut 32 that drives an angled wedge 34. Angled wedge 34 is shaped to bear against and be mated with notch 26 of driving post 28. A bushing 31 helps seats lead screw 30 in place. In FIG. 4*b*, nut 32 and bushing 33 are contained within the sleeve of and cooperate with spring component 35. Thus, turning the adjustment dial turns shaft 30 and nut 32 which moves angled wedge 34 within notch 26 causing mushroom 16 to move away from body 12 or toward body 12.

It can be seen that adjustment of dial 22 will move lateral mushroom 16 and medial mushroom 18 either away from body 12 or toward body 12 to adjust the width of the last. When mushrooms 16 and 18 are drawn into body 12 so that they abut body 12, that position corresponds to the narrowest width of the last. As currently contemplated, lateral and medial mushrooms 16 and 18 move equal distances away from or toward body 12 upon adjustment of dial 22. In general customized width sizing for most feet is best accomplished with equal distant movement of the lateral and medial mushrooms. However, it is within the scope of the invention to provide a separate adjustment dial for each width mushroom to add another parameter to further customize the fit.

Figure 4F:
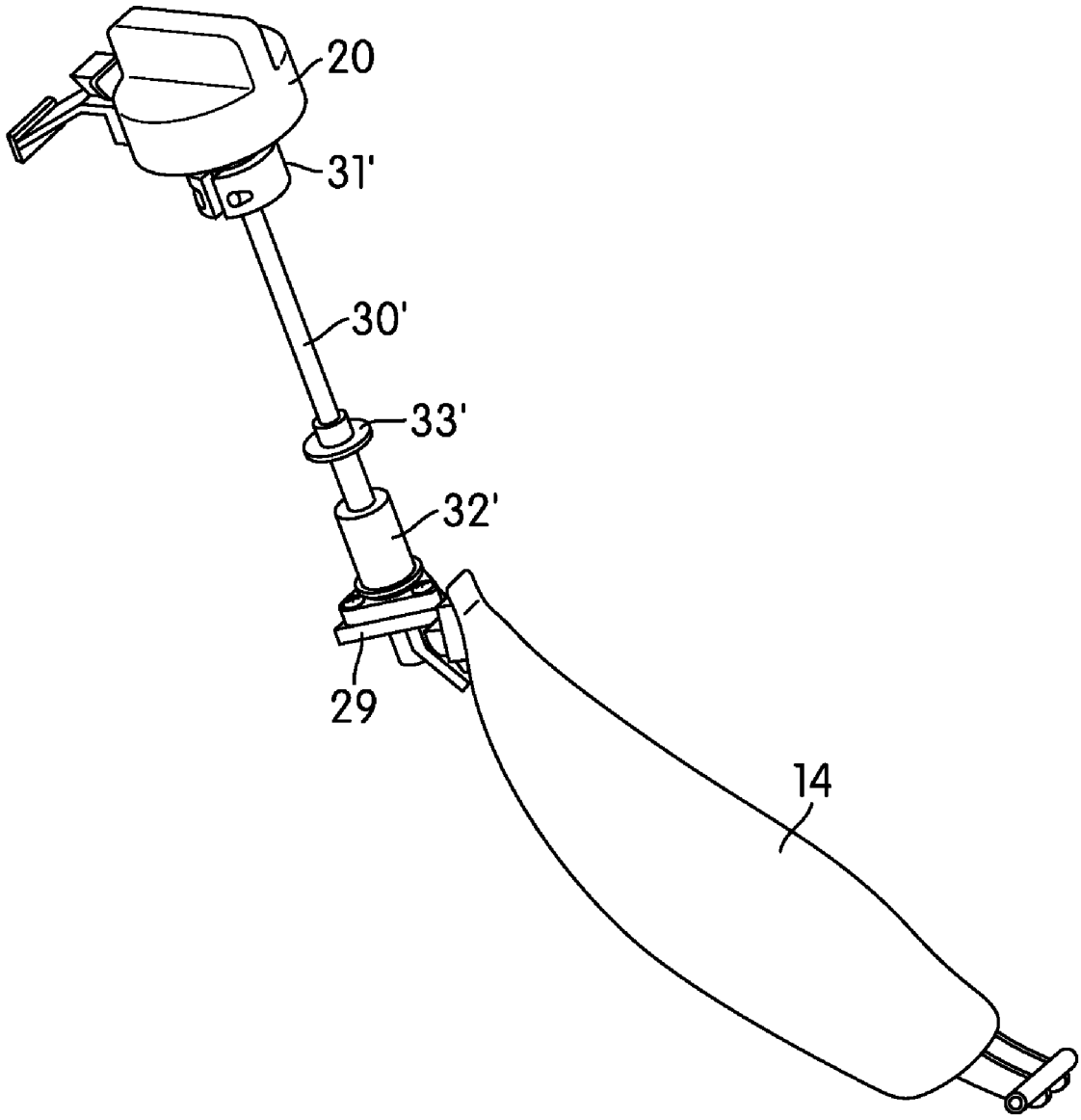
FIG. 4*f* is a perspective assembly view of the instep mushroom adjustment mechanism of the adjustable shoe last.
Figure 5:
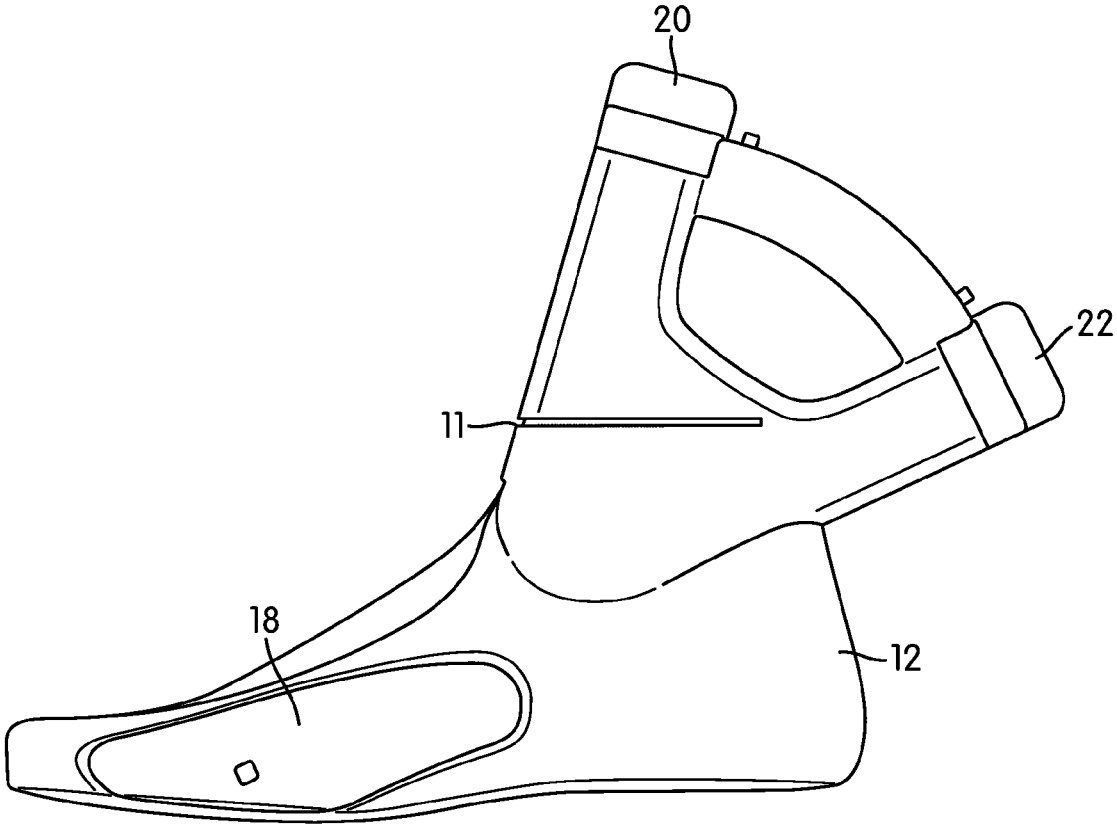
FIG. 5 is a medial side elevational view of the adjustable shoe last shown in FIG. 1.
Figure 6:
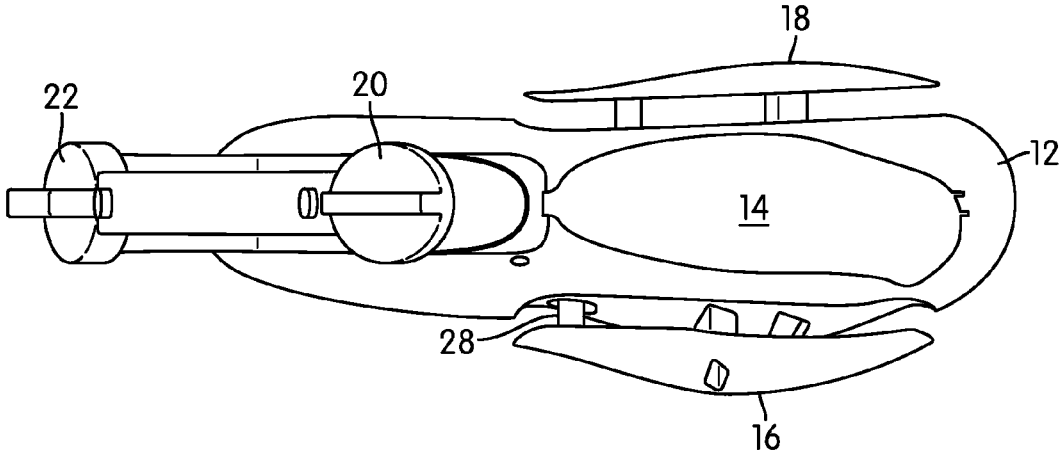
FIG. 6 is a top plan view of the adjustable shoe last shown in FIG. 1.
Figure 7:
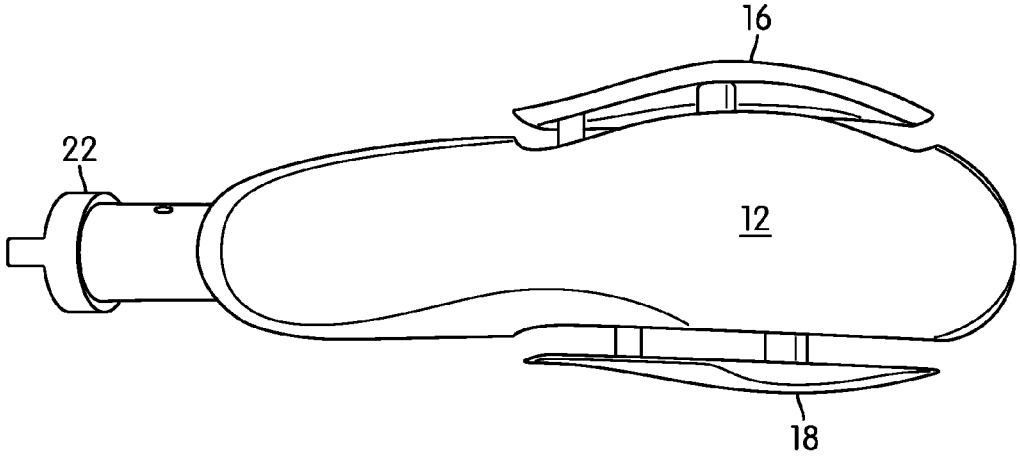
FIG. 7 is a bottom plan view of the adjustable shoe last shown in FIG. 1.

The adjustment mechanism for instep mushroom 14 is shown in FIGS. 4*b* and 4*f* and includes a lead screw 30' coupled to adjustment dial 20. Bushing 31' helps to seat lead screw 30'. Lead screw 30' drives nut 32' which moves instep adapter 29. In FIG. 4*b*, nut 32' and bushing 33' are contained within the sleeve and of and cooperates with spring component 35'. Therefore, adjustment of dial 20 moves lead screw 30' which in turn results in movement of nut 32' and instep adapter 29 to effect movement of instep mushroom 14.

Adjustment of the medial, lateral and instep mushrooms affects the girth of the last, and a girth measurement of a wearer's foot can be accommodated by adjustment of even two of the three mushrooms, instead of using just the instep mushroom.

Of course, any known mechanism such as a worm gear arrangement or an advancing ratchet assembly, or the like may be used to propel movement of the mushrooms upon turning of their respective dials. Although the adjustment mechanism as described herein refers to adjustment dials, any sort of calibration mechanism may be used in its place. Other calibration mechanisms and adjustment indicators such as a linear slide scale or an LED indicator with a touchscreen, or the like are within the scope of the invention. In this aspect the term "dial" is used broadly to refer to any sort of calibration mechanism and adjustment indicator.

Figure 8A:
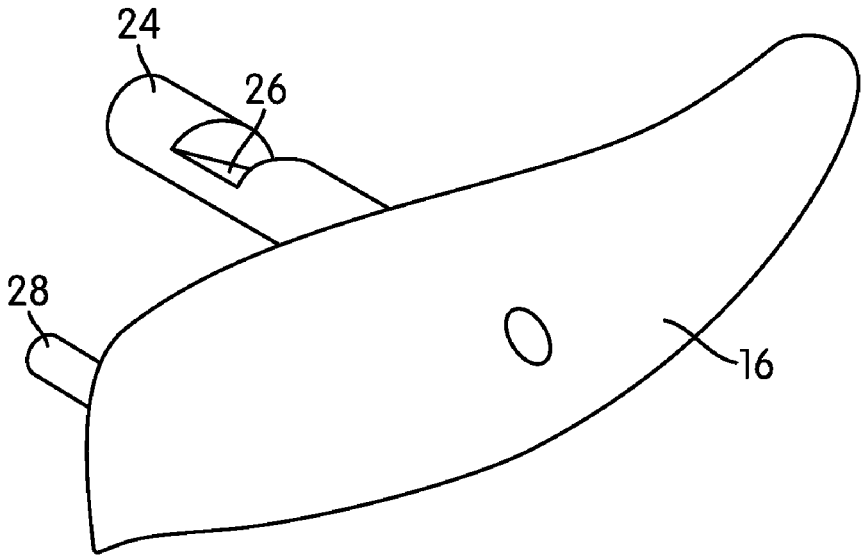
FIG. 8*a* is a perspective view of the lateral width mushroom.
Figure 8B:
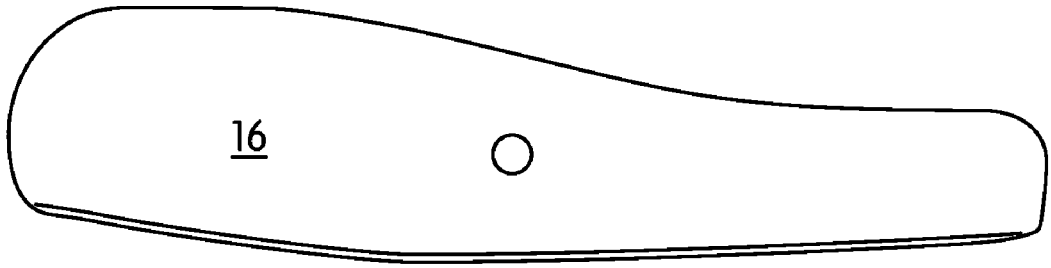
FIG. 8*b* is a side view of the lateral width mushroom of FIG. 8*a*.
Figure 8C:
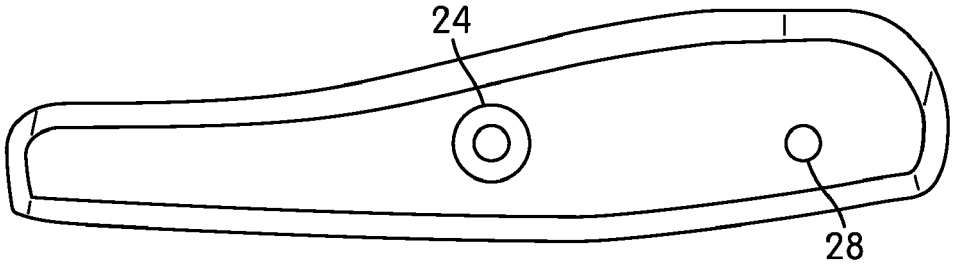
FIG. 8*c* is an interior side view of the lateral width mushroom of FIG. 8*a*.
Figure 8D:
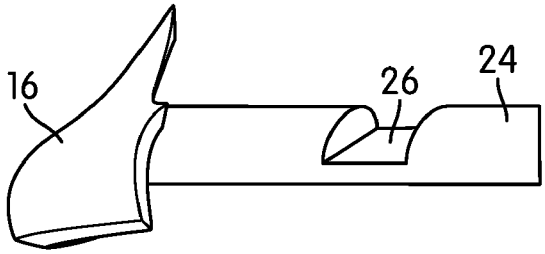
FIG. 8*d* is a front elevational view of the lateral width mushroom of FIG. 8*a*.
Figure 8E:
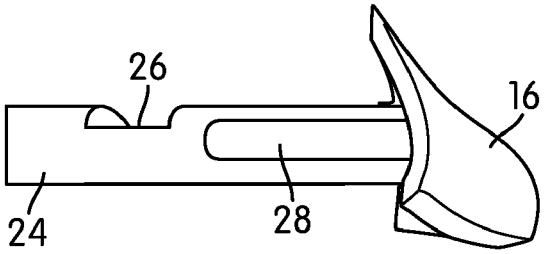
FIG. 8*e* is a rear elevational view of the lateral width mushroom of FIG. 8*a*.
Figure 8F:
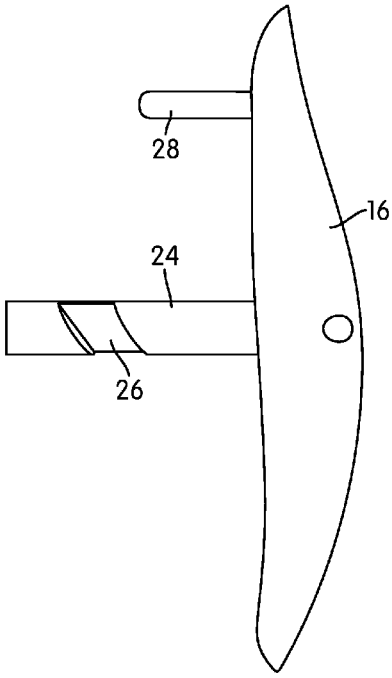
FIG. 8*f* is a top plan view of the lateral width mushroom of FIG. 8*a*.
Figure 8G:
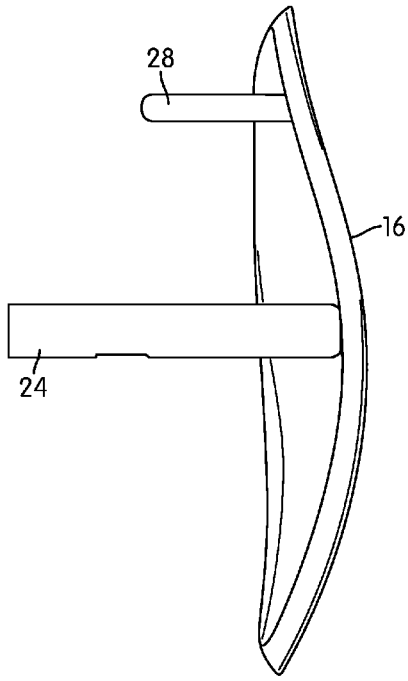
FIG. 8*g* is a bottom plan view of the lateral width mushroom of FIG. 8*a*.

The mushrooms on the adjustable last are designed to have flexible peripheries to ensure smooth transition surfaces on the finished shoe. Referring to FIG. 8*b*, as an exemplary figure, the periphery of mushroom 16 is flexible so that the shoe upper does not have a stepped appearance in the transition regions between the portions supported on mushroom 16 and the portions supported on the last body. The flexibility of the mushroom peripheries can be accomplished in a number of ways. One example is to form the mushroom from a single material and ensuring that the periphery is sufficiently thin to flex to provide the smooth transition. Another way is to form the mushroom from more than one material, a flexible material along the periphery and a more rigid material in the center where the posts are connected.

Figure 9:
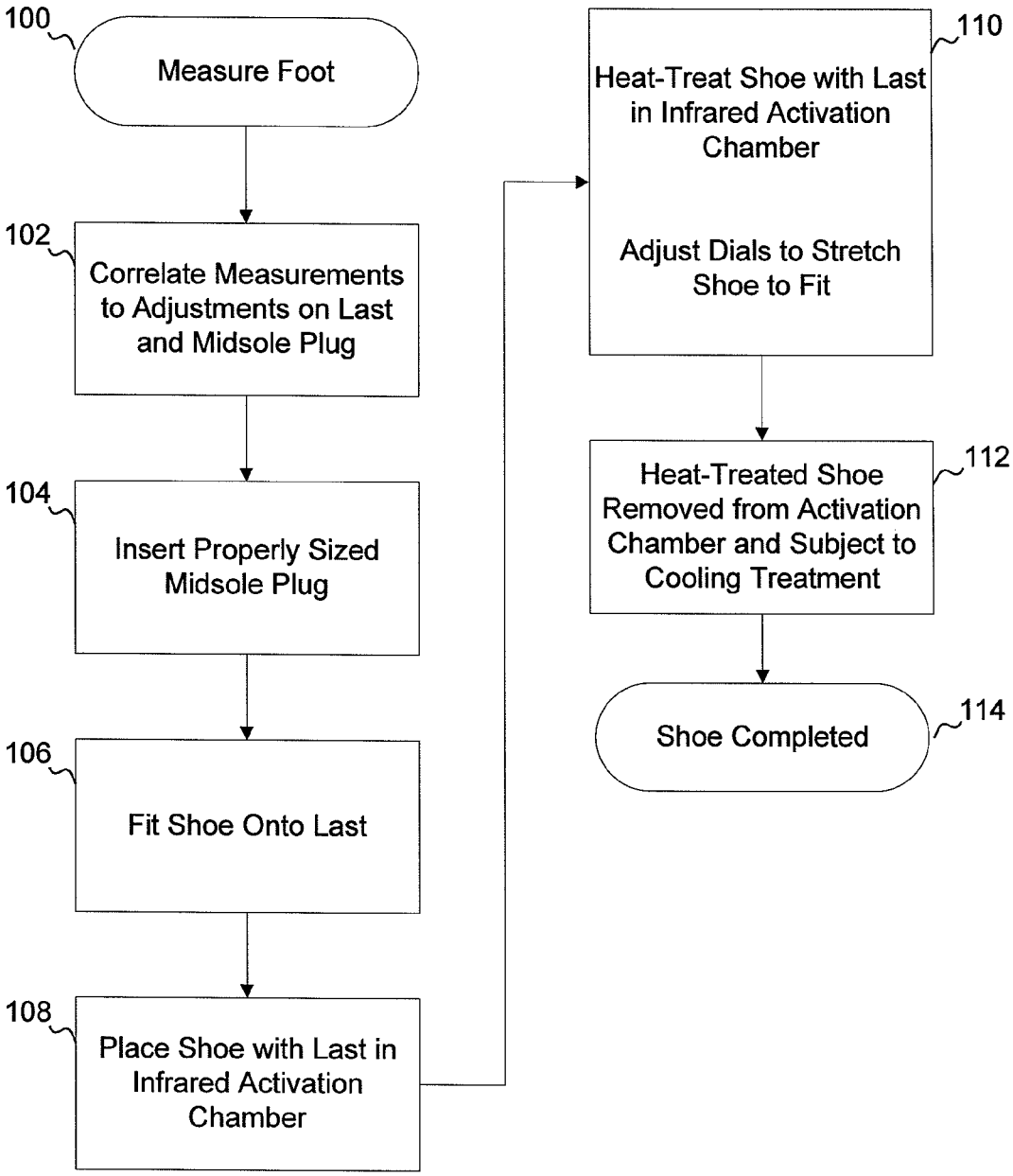
FIG. 9 is a flow diagram showing an overview of the measurement, last selection, heat treatment, adjustment and fit process of the present invention.

Adjustable last 10 is one of the primary components in the custom fit system. FIG. 9 provides an overview of the entire process for making the custom fit shoes. First, in step 100, the wearer's foot is measured using an electronic foot scanner or another well known device such as a Brannock device. Second, the foot measurement data is used to calculate a shoe size and adjustment settings on adjustable last 10 and the appropriate midsole plug size in step 102. In step 104, the appropriately sized midsole plug is inserted into the midsole. Next, in step 106 a specially designed shoe with heat malleable activation zones is fitted onto adjustable last 10. The lasted shoe is placed in an activation chamber in step 108. The lasted shoe is activated in the activation chamber in step 110. During step 110, the calibration mechanisms of the last are adjusted after some amount of treatment has occurred so that the material of the activation zones is plastic. The last dimensions are thus adjusted to an appropriate fit quality. The lasted shoe is further treated to set the activation zones of the shoe and thus fix the width size. The treated shoe and last are removed from the activation chamber, step 112. The treated, lasted shoe is subject to a cooling treatment either by cooling at room temperature or optionally in a cooling appliance to "set" the activation zones on the shoe, step 114. After cooling, the last is removed from the shoe, step 116, and the custom sizing of the shoe is then complete, step 118.

A description of the measurement parameters will now be described. Following that, the other main components of the system will be described, followed by a description of the devices and subroutines used for measuring the foot and using the measurement data to calculate the adjustment settings of the last and midsole plug sizes.

Figure 10A:
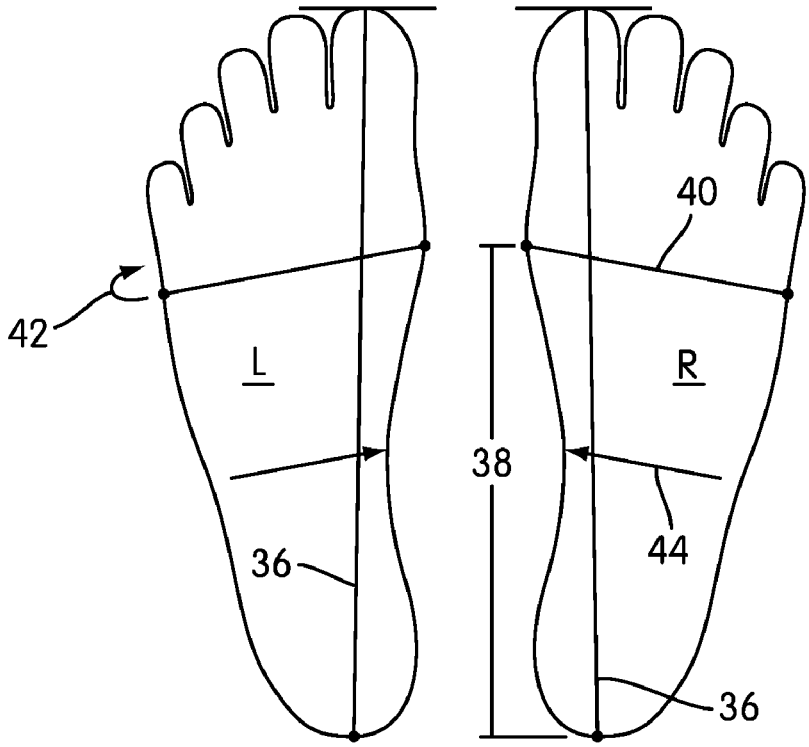
FIG. 10A is a schematic diagram of the left and right feet showing the measurements to be taken.
Figure 10B:
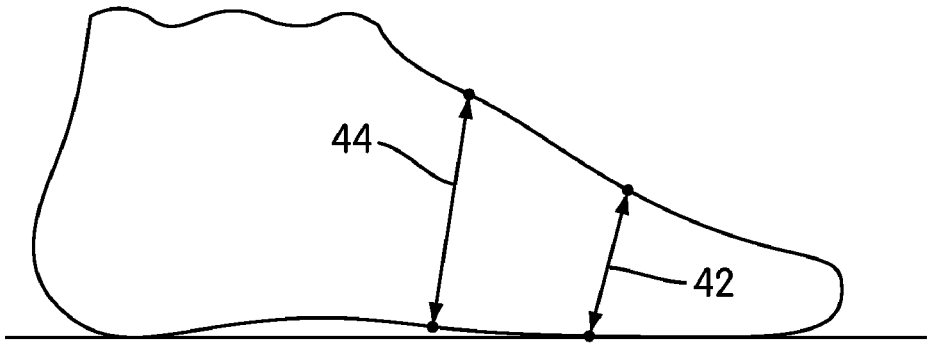
FIG. 10B is a lateral elevational view of a right foot showing the measurements to be taken.

Primary to a customized fit is the measurement data that is used to set the adjustments and determine the size of midsole plugs used. FIG. 10A is a schematic representation of left and right feet, L and R, respectively, and FIG. 10B is a lateral side elevational view of a right root, R, showing the main measurements to be taken. Total foot length (FL) 36 is the dimension from the tip of the big toe to the heel. The ball length (BL) 38 is the dimension from the heel to the medial ball of the foot. Foot width (W) is 40 the dimension from the medial ball to the lateral ball of the foot. Ball girth (G) 42 is the measurement of the circumference around the foot intersecting the medial ball and lateral ball of the foot. Instep girth (IG) 44 is the measurement of the circumference around the foot at the slimmest width of the foot. In the present invention, all of these measurements are taken in millimeters, but any other system may also be used.

Figure 11:
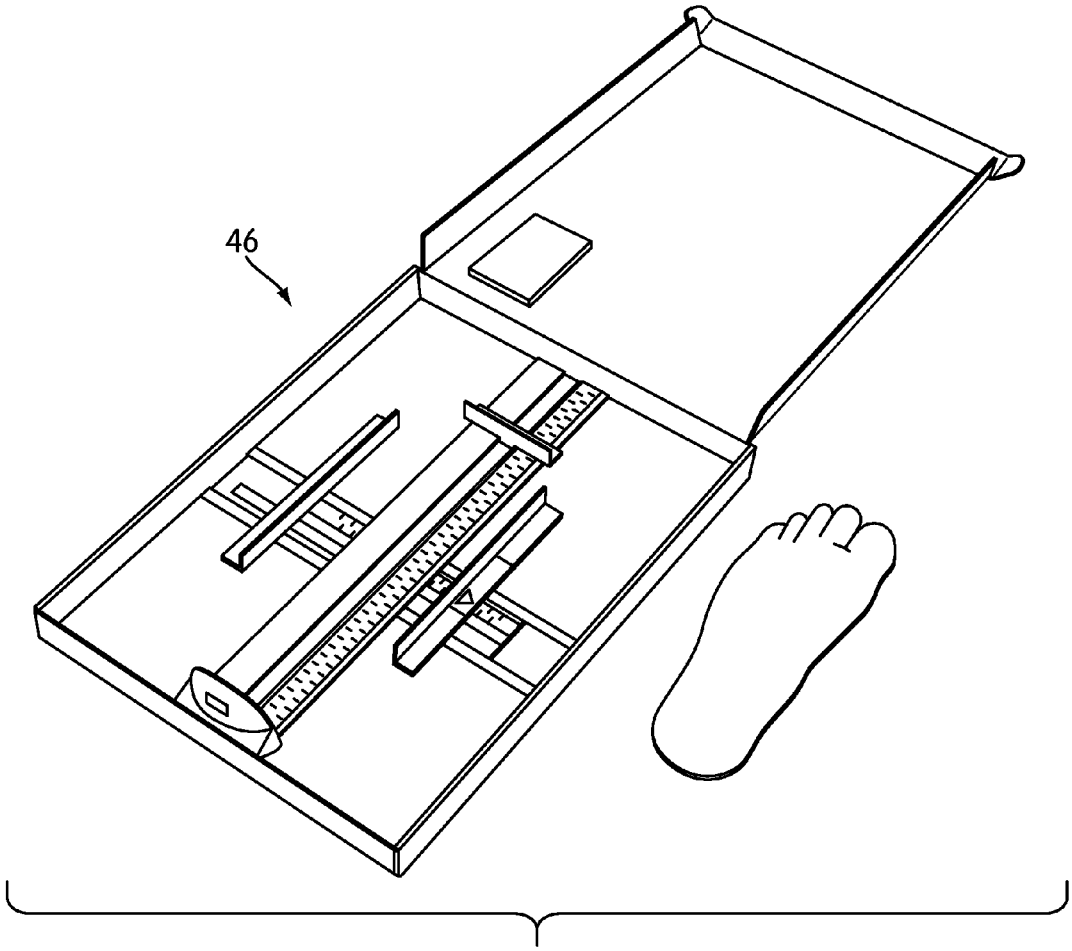
FIG. 11 is a perspective view of a foot measurement tool.

A variety of foot measurement tools can be used to obtain basic data of the wearer's foot. An example of a simple foot measurement tool 30 used to measure the length and width is shown in FIG. 11. This type of foot measurement tool is the subject of U.S. patent application Ser. Nos. 10/159,961 filed May 29, 2002, and 10/316,117 filed Dec. 11, 2002, the entire disclosures of which are hereby incorporated by reference. Of course any other type of linear measure could be used such as the conventional Brannock™ device.

A more sophisticated measurement device is a three-dimensional foot scanner 48. The scanner has an angle collar surrounding the ankle so as to block out ambient light from the scanning chamber. The present invention employs a foot scanner which is available on the market and manufactured by the I-Ware Laboratory Co., Ltd. of Osaka, Japan. Representations and specifications of the I-Ware foot scanner are provided on the I-Ware website (www.iwl.jp), and are hereby incorporated by reference. Once the foot is placed in the scanning chamber on the scanning surface and the lids closed, the scanner automatically detects the heel, toes, medial ball and lateral ball of the foot which are the reference points on which the measurements are based. These measurements are preferably taken in millimeters, and this measurement data is used to calculate the custom last settings on adjustable last 10 and the appropriate midsole plugs for the midsole. The measurements shown in FIGS. 10A and 10B are taken automatically by an electronic scan of the foot, and the measurement data is stored by any convenient reference means, the individual's name or an identifying number. Either the scanner's onboard computer or a separate computer C, FIG. 25, contains the software for using the measurement data to calculate the appropriate adjustment settings as contemplated by the present invention. A computer display preferably displays the measurements and the calculated results.

Figure 12:
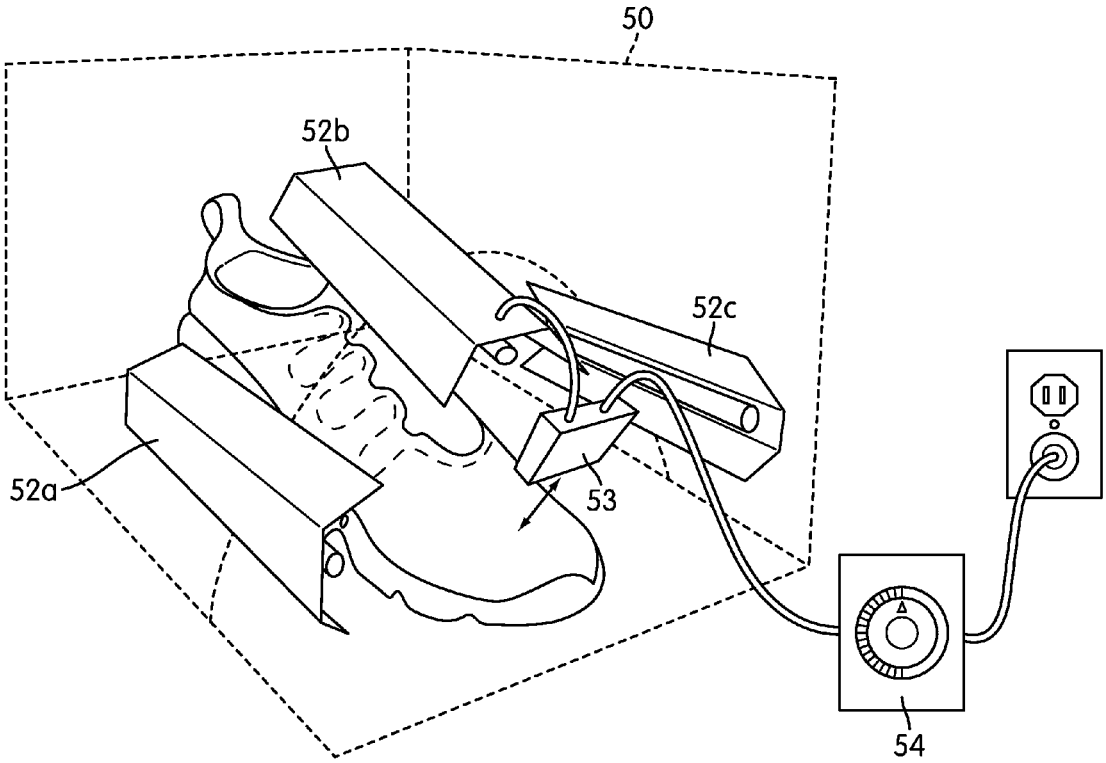
FIG. 12 is a schematic view of some components of an infrared activation chamber.
Figure 13:
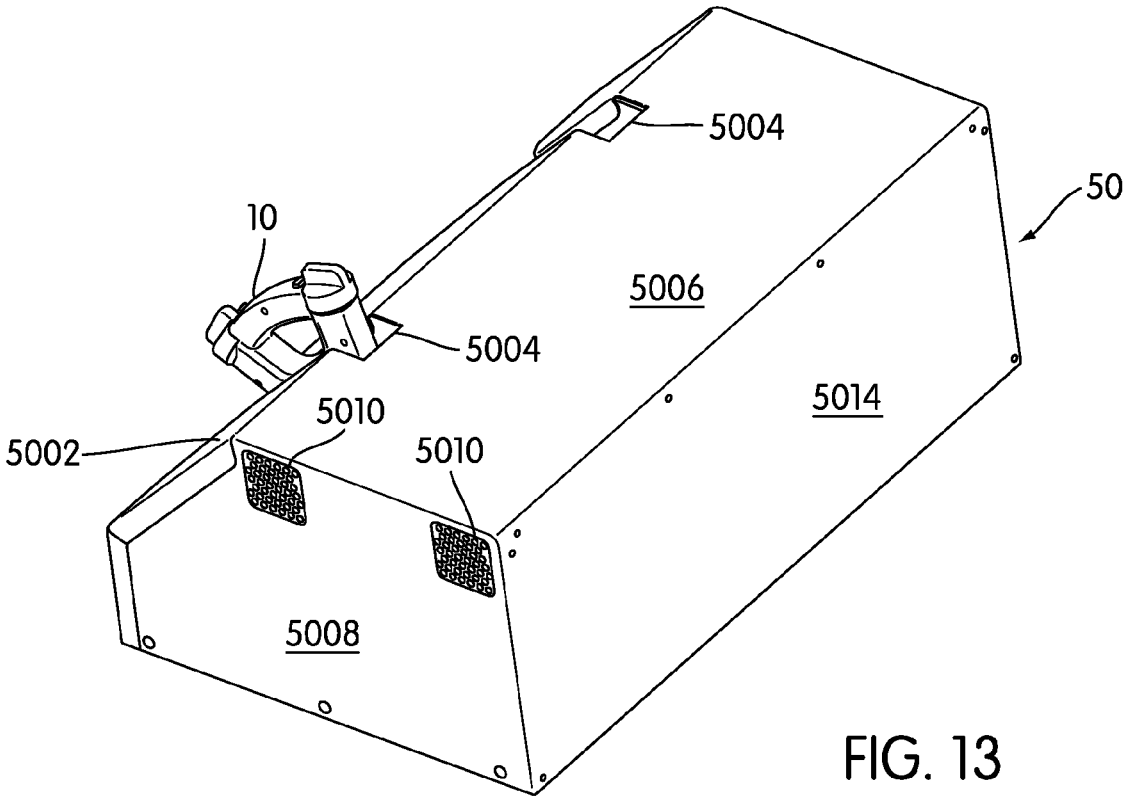
FIG. 13 is a perspective view of an infrared activation chamber showing the shoe and last in place for infrared heat treatment.
Figure 14A:
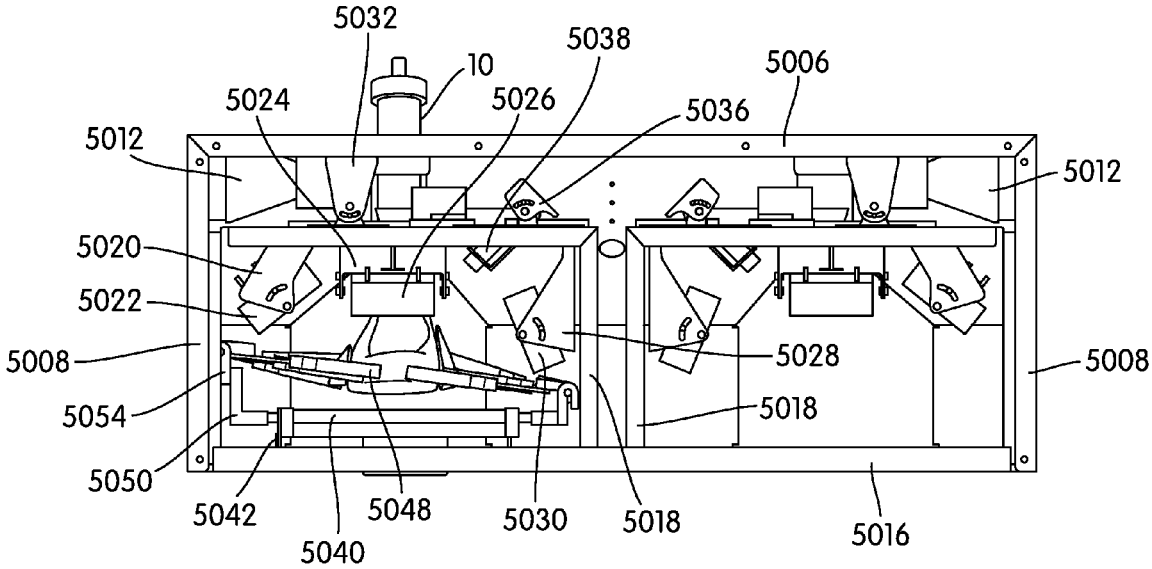
FIG. 14*a* is an end elevational view of the chamber of FIG. 13 without the front wall.
Figure 14B:
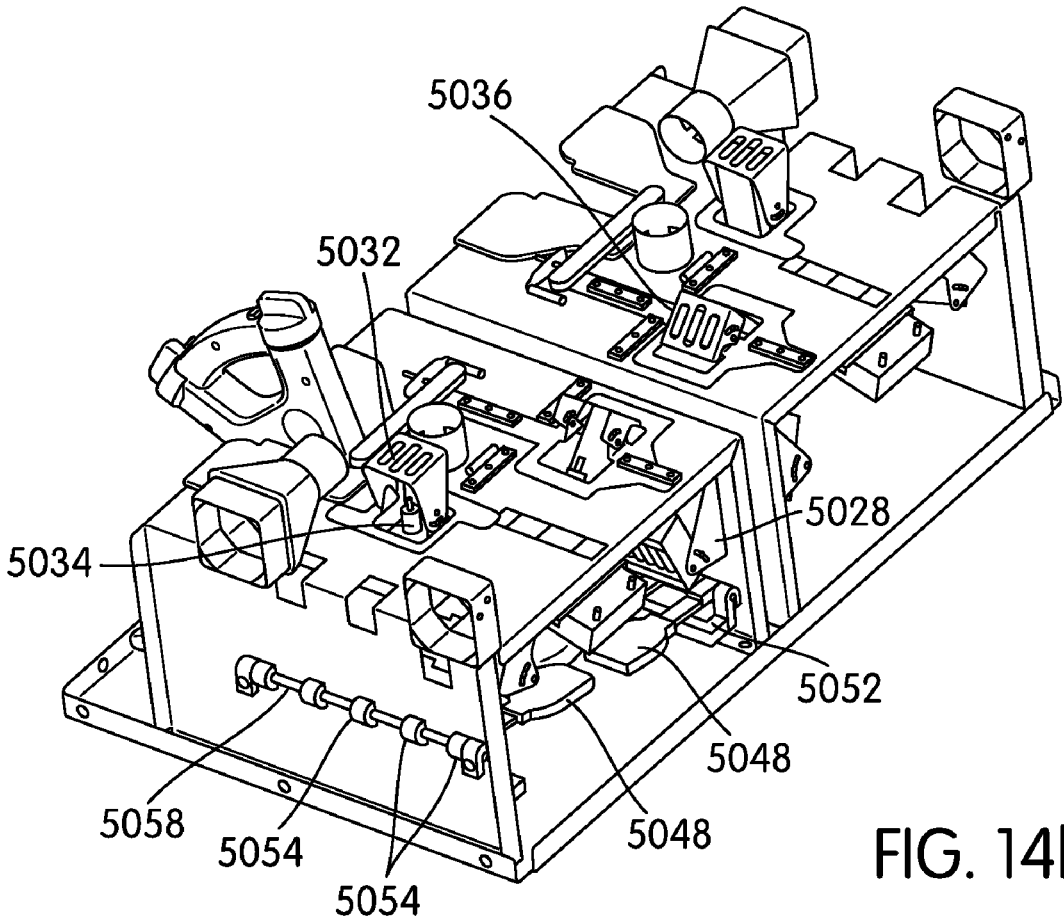
FIG. 14*b* is a perspective view of the chamber of FIG. 13 without the exterior walls.
Figure 14C:
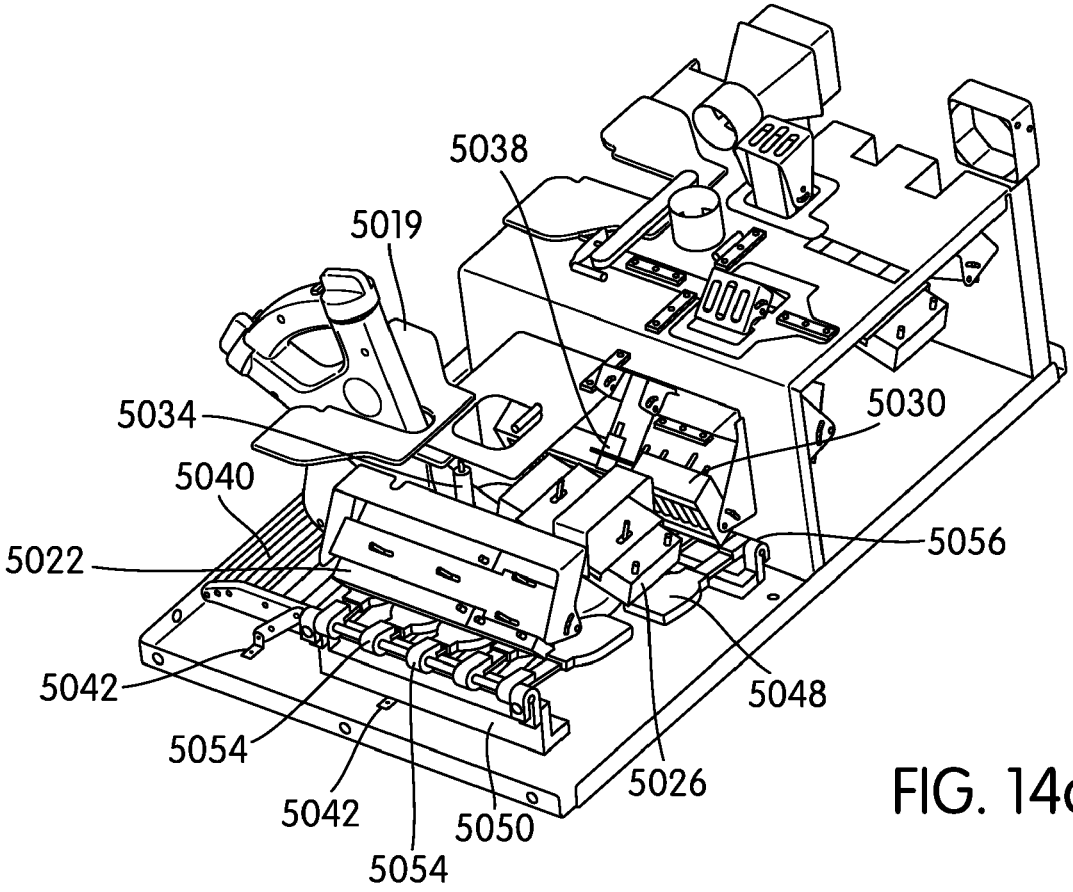
FIG. 14*c* is another cut-away perspective view of the chamber of FIG. 13 without the interior bracket on one side.
Figure 14D:
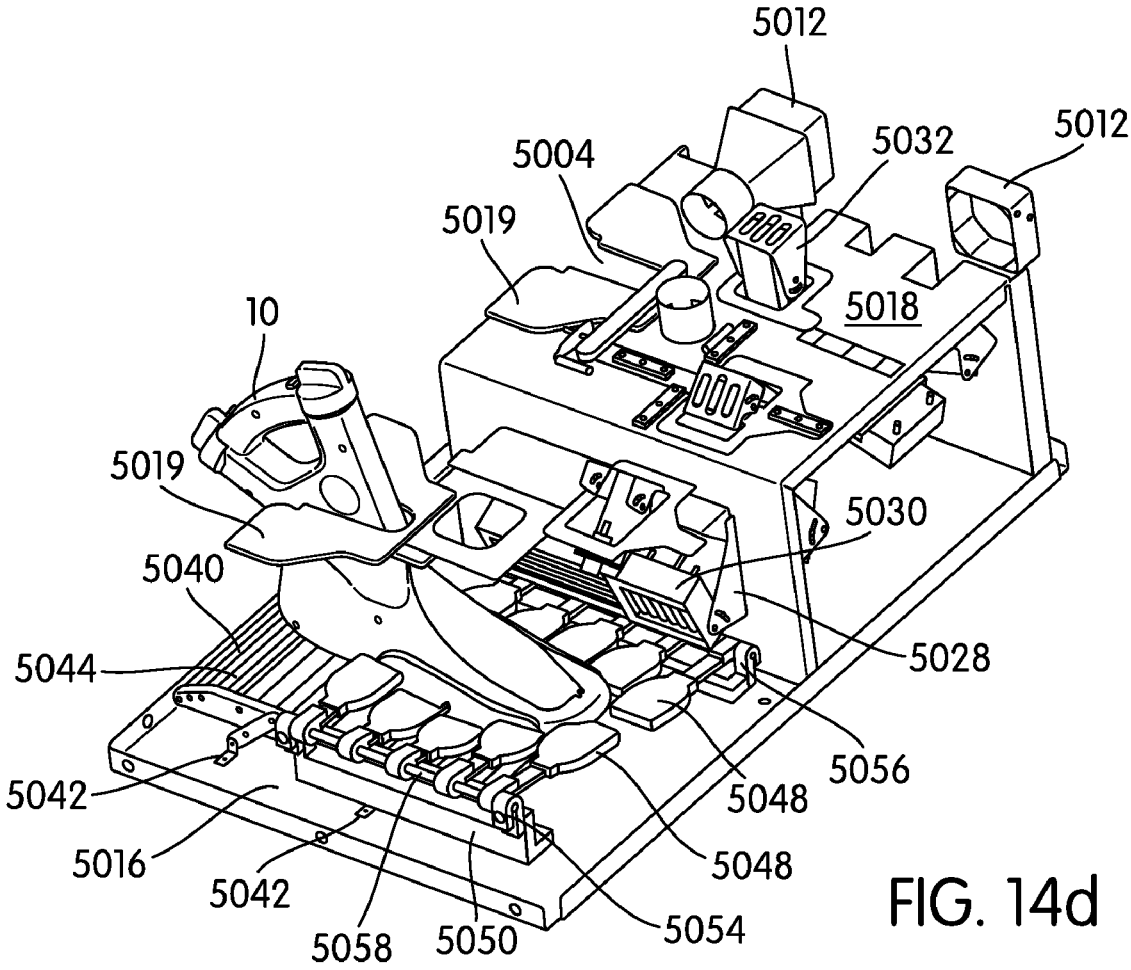
FIG. 14*d* is another cut-away perspective view of the chamber of FIG. 13 with more elements removed to show detail.

Another component of the custom shoe fitting system is an infrared (IR) activation chamber 50 which is shown schematically in FIG. 12, and in more detail in FIGS. 13-14*d*. As shown schematically in FIG. 12, IR activation chamber 50 is designed to receive a pair of lasted shoes into left and right activation areas. FIG. 12 illustrates schematically some components of one such activation area in which three infrared lamp elements 52*a*, 52*b*, and 52*c* are positioned about the lasted shoe, and a pyrometer 53 is positioned above the toe area of the shoe. The lamp elements and pyrometer are coupled to a controller 54 which is coupled to a computer to control the heating of the lamp elements and the amount of time of exposure to treat the shoe.

The exterior of activation chamber 50 is illustrated in FIG. 13. For clarity of illustration, the cut-away views, FIGS. 14*a*-14*d*, illustrate chamber 50 with various elements hidden or not shown. In FIGS. 13 and 14*a*-14*d*, IR activation chamber 50 has two activation areas, and these drawings focus on the area for the right shoe to illustrate the internal components in more detail. The internal components of the chamber in FIGS. 14*a*-14*d* will be numbered with reference numerals in the 5000 series. In these figures, the chamber is shown with adjustable last 10 without a shoe, but it will be understood that the last would have a shoe fitted onto it when it is inserted into the IR activation chamber.

As seen in FIG. 13, the housing of chamber 50 includes a rear wall 5002 with slots 5004 through which last 10 protrudes when a lasted shoe is in place. Slots 5004 extend through a portion of top wall 5006 of chamber 50 as well. Side walls 5008 include ventilation openings 5010 for fans 5012. Front wall 5014 and base 5016 complete the housing of the chamber.

FIG. 14*a* is a front elevational view of the chamber with front wall 5014 removed to illustrate the internal components. FIG. 14*b* is a perspective cut-away view of the chamber with the top wall and all of the side walls removed. FIG. 14*c* is similar to FIG. 14*b*, but main bracket 5018 is not shown on the activation area with the lasted shoe to more closely show the internal components. FIG. 14*d* is similar to FIG. 14*c* but with the lateral and instep lamps removed to even more closely show the carriage components on which the lasted shoe is supported.

With reference to FIGS. 14*a*-14*d*, the activation area on the left side will be described in more detail with the understanding that activation area on the other side is mirror image. Where it is clearer in the drawings, the corresponding elements on the other activation area is labeled. Inside the housing, each activation area is defined by a three sided support bracket 5018. Main bracket 5018 includes a last dock element 5019 which defines the internal portion of slot 5004. Last dock element 5019 includes a switch or other type of detection mechanism which interacts with detent 11 on last chassis 12 to confirm proper placement of the last in the activation chamber and enable the activation chamber to operate. Main bracket 5018 also supports fans 5012 between the main bracket and the housing walls. Additionally, main bracket 5018 supports the lamp mount brackets as follows: lamp bracket 5020 for lateral lamp 5022, lamp bracket 5024 for instep lamp 5026, and lamp bracket 5028 for medial lamp 5030. The chamber also includes a plurality of pyrometers connected to the control system for measuring the infrared radiation in at least two areas of the lasted shoe. Main bracket 5018 therefore includes instep pyrometer bracket 5032 supporting instep pyrometer 5034, and side pyrometer bracket 5036 supporting side pyrometer 5038.

Lamps or heaters 5022, 5026 and 5030 are mounted onto main bracket 5018 via their individual brackets. The mountings of two of the heaters may be designed so that the heater positions can be adjusted. Such adjustment may help to fine tune the positions of the heaters for different sizes of lasts used in the activation chamber. If two of the three heaters are adjustable, it is generally possible to keep the third heater stationary and maintain the optimal tuning. Pyrometers 5034 and 5038 are mounted as shown to provide feedback to the control system regarding the temperatures of the activation zones of the shoe. Based on these readings the process can be controlled by the computer.

In the embodiment of the activation chamber shown in the drawings, the instep lamp and the medial lamp are mounted to be stationary within the chamber, and the lateral lamp is mounted to move in order for the three lamps to be in optimal position for treating the lasted shoe. The instep and medial lamps are controlled by the feedback from the instep pyrometer, and the lateral lamp is controlled by the feedback from the lateral pyrometer. The stationary lamps and pyrometer are positioned to provide treatment coverage for a wide array of sizes. Movement of lateral lamp 5022 and instep pyrometer 5034 is governed by the size of the last. As described previously, last chassis 12 has a detent 11 which engages a switch on last dock element 5019 when the lasted shoe is positioned in the activation chamber. A smaller last will insert more deeply into last dock element 5019, so that the movable lamp and pyrometer will be positioned appropriately. A larger last's detent will engage the switch in last dock element 5019 earlier to thereby result in appropriate positions for the movable lamp and pyrometer. The mounting of the lamps and pyrometers as movable or stationary in any combination are within the scope of the invention.

As best seen in FIG. 14*b*, chamber 50 is equipped with a number of fans 5012 to ventilate the chamber. The fans closest to the rear wall also include ducts 5013. Fans 5012 ventilate through openings 5010 in the side walls of the housing.

A carriage 5040 for supporting the lasted shoe is positioned near the base of the chamber and is attached to base 5016 via a set of two bar linkages 5042. Linkages 5042 enable up and down movement of the carriage. Carriage 5040 is comprised of a series of parallel shafts 5044 extending between longitudinal flanges 5046, the shafts providing the supporting surface for the lasted shoe. FIG. 14*a* shows a space between the bottom of the last and carriage to accommodate the thickness of the sole of a shoe that is fitted onto the last. If a shoe is on the last, the sole of the shoe would rest on the carriage.

When a lasted shoe is inserted into the activation chamber, the midsole and sole elements, also known as the tooling, must be protected from treatment since these thermoplastic elements of the shoe should not be exposed to infrared radiation while the shoe upper is treated. To protect the tooling, activation chamber 50 is provided with a series of protective shields or silicon brushes 5048 arrayed within the target zone. Along the sides of the main bracket are attached a lateral plate shield 5050 and a medial plate shield 5052 via shaft clamps 5054 on the lateral side and clamps 5056 on the medial side respectively. Each plate shield supports a rod 5058 onto which brushes 5048 are rotatably mounted. Brushes 5048 are rotatably mounted so as to enable them to cam against the surface of the tooling when a lasted shoe is placed in the target zone to ensure full protection of the tooling. The movement of the silicone brushes is coupled to the linkages 5042 so that movement of the carriage is tied to movement of the brushes. In this manner, different sizes of shoes are accommodated by this camming action of the silicon brushes.

To ensure that IR radiation is applied only when a lasted shoe is placed on carriage 5040, the present invention employs at least one safeguard: the shoe and chamber are outfitted with mating radiofrequency (RF) ID tags so that the chamber can only be activated when a shoe with the appropriate RF ID tag is placed therein. FIG. 14*a* shows RF ID reader 5060 mounted on base 5016 underneath carriage 5040. This will prevent heat treatment of shoes that are not designed for the adjustable last and the custom fit system. Another safeguard is the switch on the last docket element which must be engaged by the detent on the last chassis only when a shoe and last are placed therein to enable operation of the chamber. Of course this type of switch and detent combination may be positioned elsewhere in the chamber or carriage where the placement of the shoe and last for treatment would result in the switch being closed and rendering the chamber operational.

Figure 15:
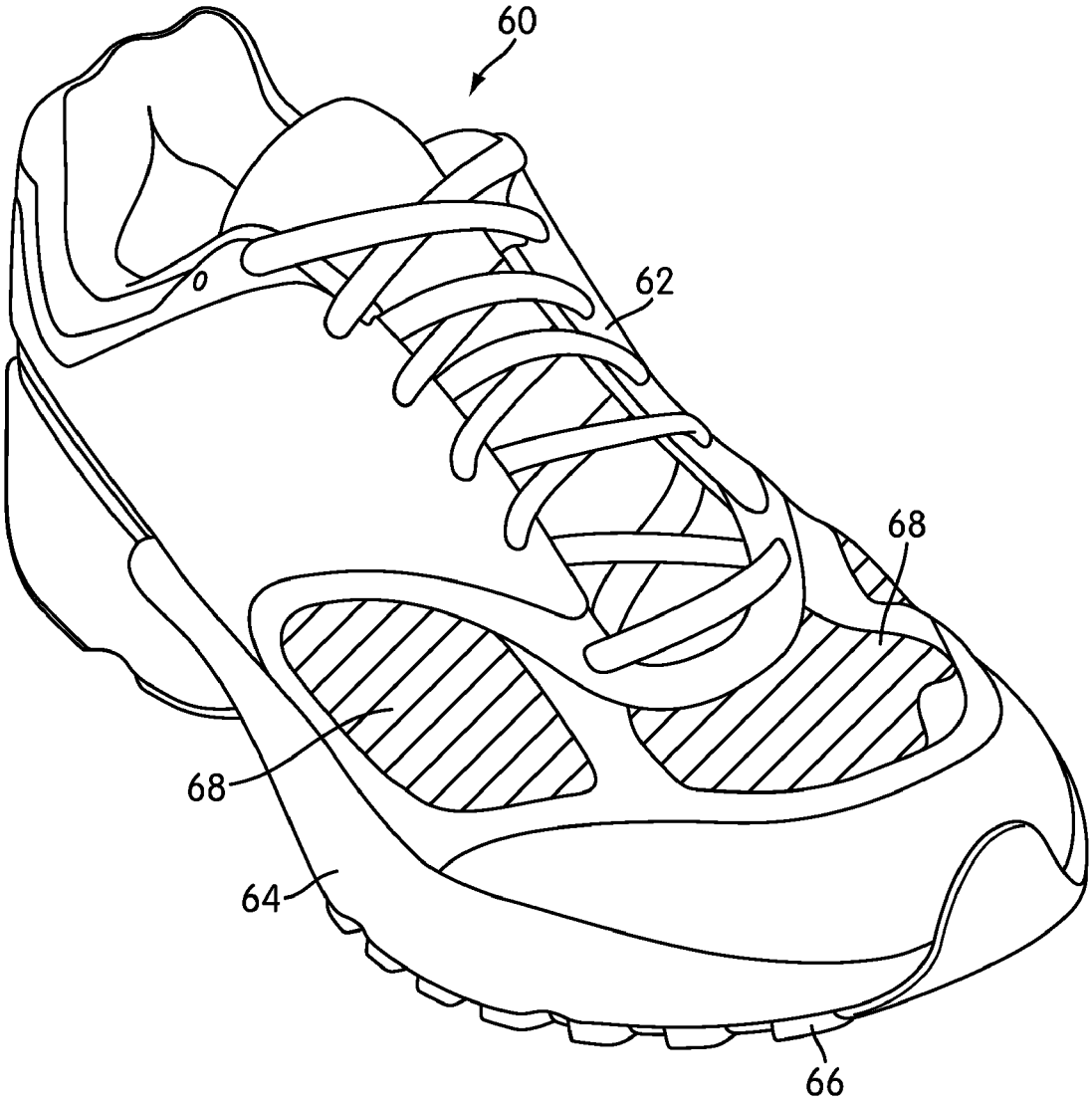
FIG. 15 is a side view of an athletic shoe showing shading on the adjustable portions of the upper.

Shoe 60 which is specially designed to be fitted onto the adjustable last and then heat treated for sizing will be manufactured in a single width with an upper 62 forming a cavity for receiving the wearer's foot, a midsole 64 attached thereto, and an outsole 66 providing the ground engaging outer surface is shown in FIG. 15. Each of these components is engineered to enhance the effectiveness of the custom fit system. Upper 62 is made of any number of materials, many which are typical to use in shoe manufacture such as leather, fabric, engineering fabrics, etc. Certain portions of upper 62 are made of a special material which can be "heat set" to size. This material is heat malleable. Broadly, heat malleability refers to the ability of the material to either stretch upon heat treatment or shrink upon heat treatment. If the material stretches upon heating, the shoe would be made in the narrowest width. Conversely, if the material shrinks upon heating, the shoe would be made in a single width that is relatively wide. The remainder of this description will be directed to a shoe upper with activation zones which are heat malleable to stretch to fit, but the disclosure encompasses the opposite, that is, a shoe that can be "shrunk to fit." In shoe 60 shown in FIG. 15, the areas delineated by hatching are activation zones 68 which are made of heat malleable material.

Shoe 60 as illustrated is one example of many possible variations of the shoe that could be used with the custom fit system described herein. This particular shoe is shown with activation zones in the forefoot area, but it is within the scope of the invention to design a shoe with activation zones elsewhere on the upper. For example, the shoe may have an activation zone in the instep area, particularly if it has a different lacing system or no lacing system at all and resembles a loafer. The activation zones are preferably made of polyester spacer mesh material which is stretched to fit on the adjustable last. When this material is subjected to IR radiation in the IR activation chamber, it will be heat set to the settings of the adjustable last to therefore take on the width/girth dimensions of the last. It is possible to pre-treat the polyester material for performance or heat treatment improvements. In this manner, upper 62 is custom fitted to the individual's foot based on the settings of the last which were calculated from the measurements taken from the scan of the foot.

With regard to the activation chamber and the shoe, although the embodiment described in detail herein refers to an IR activation chamber and corresponding portions of the shoe which are made of IR treatable material, it is within the scope of the invention to employ other possible treatments and corresponding materials. The activation chamber could use other forms of energy, and the activation zones of the shoe would be made of materials which are sensitive to and treatable with the energy used in the activation chamber. For example, if the activation chamber used microwave radiation, the activation zones of the shoe would be made of material which can be shrunk or stretched and then set by microwave radiation. If a material that is sensitive and treatable by extreme cold temperatures, it would be possible to design the activation chamber to cold-treat a lasted shoe appropriately.

Figure 22:
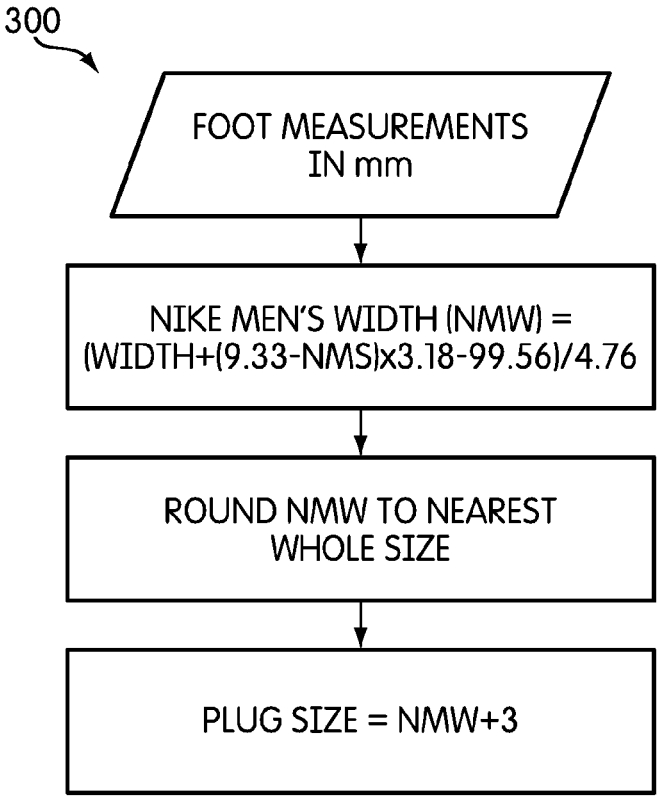
FIG. 22 is a flow diagram showing the midsole plug size calculation.

Algorithm 200 to calculate the size of the shoe from the raw foot measurement data is shown in FIG. 22 and employs the following formulas. Nike sizes for U.S. men's shoes (NMS) is calculated as follows:

$$NMS = 11.33 + \frac{FL(\text{mm}) - 279.4}{8.46}$$

For U.S. sizes for women's shoes, the Nike Women's Size (NWS) is calculated as follows:

$$NWS = 12.83 + \frac{FL(\text{mm}) - 279.4}{8.46}$$

The resulting sizes are rounded to the nearest half size.

Although the U.S. sizing system is described in detail herein, it will be understood that appropriate equations for calculating the sizes in other sizing systems is also within the scope of the invention. The equations for calculating the European sizes, for example, could be used instead.

In this custom fit system, each shoe size comes in a single width, that is, the narrowest width offered. Once the shoe size is determined in this manner, the appropriately sized shoe is selected and fitted around the adjustable last. A discussion of the width and/or girth adjustment of the upper requires an explanation of the midsole and outsole elements of the shoe and their respective adjustments since the width adjustment factor for the upper is based on a width adjustment factor for the midsole.

Figure 16:
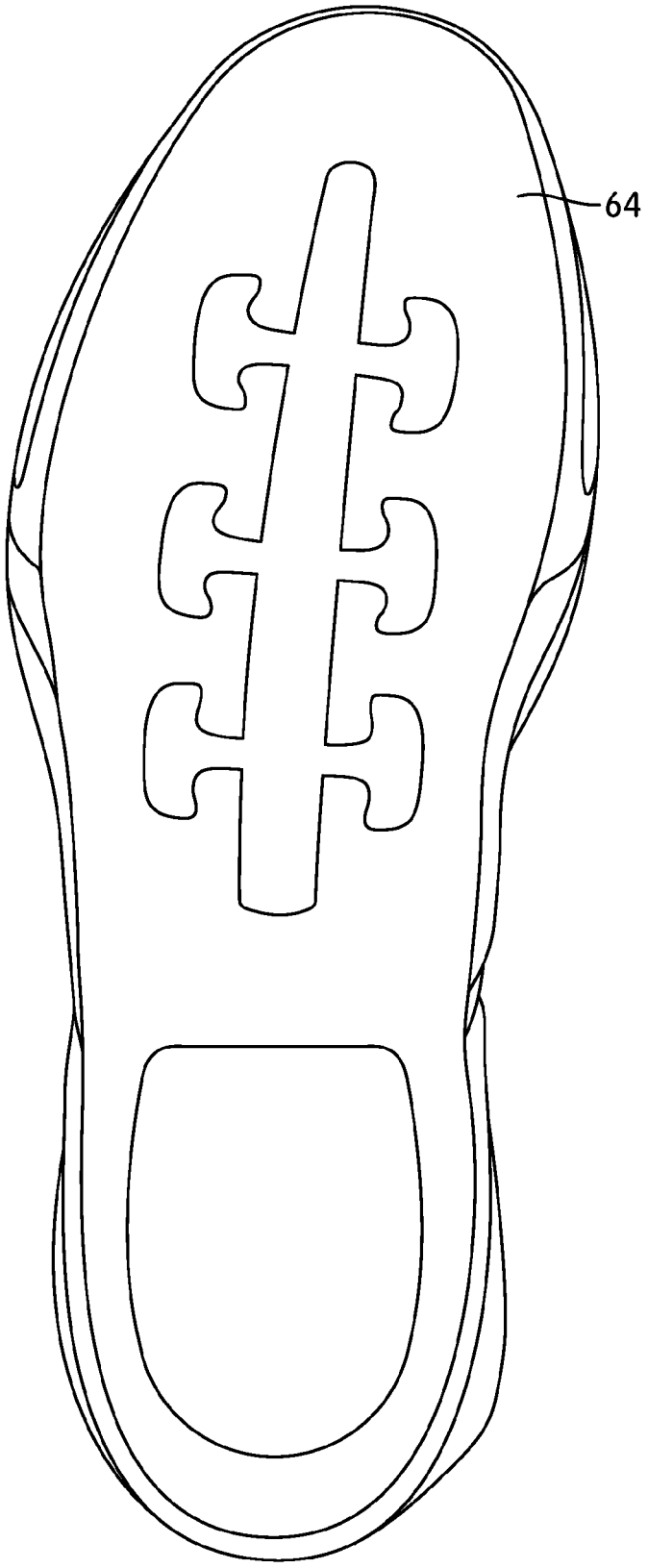
FIG. 16 is a top plan view of a midsole with adjustable plug.
Figure 17:
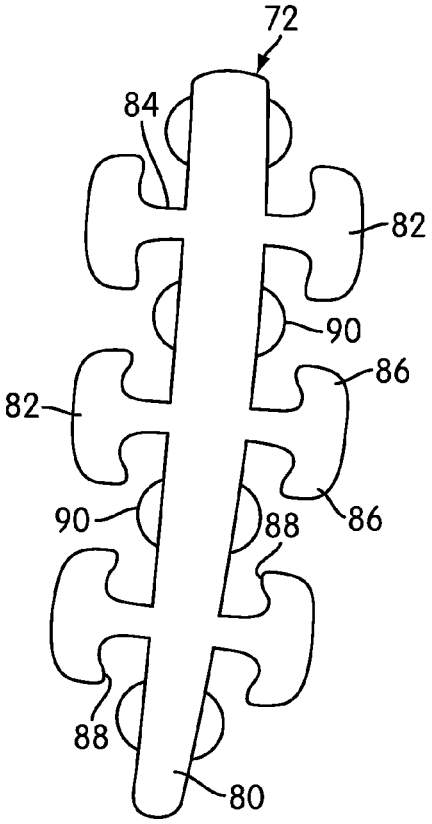
FIG. 17 is a top plan view of a midsole plug.
Figure 18:
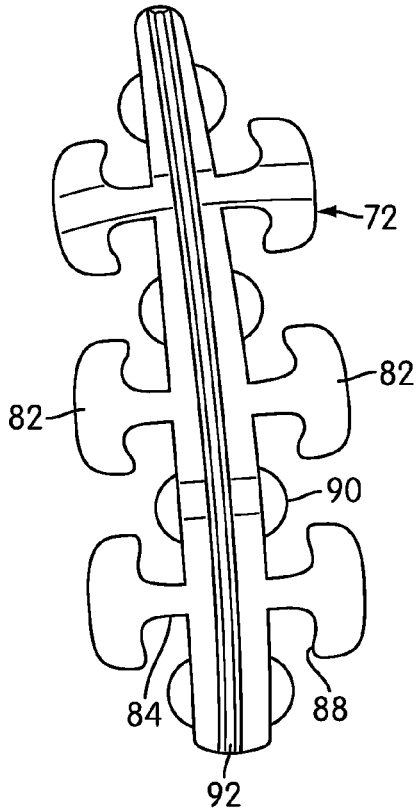
FIG. 18 is a bottom plan view of a midsole plug.

In addition to the upper, midsole 64 is also adjusted to fit the individual's foot. Midsole 64 includes an interchangeable plug to adjust for width and provide a customized fit corresponding to the fit of the upper. A preferred plug shape is shown in FIGS. 16-18. The plugs are sized to adjust for the width of the midsole depending on the size of plug inserted. The concept of midsole plugs is described in detail in commonly assigned U.S. patent application Ser. No. 10/146,480 filed May 14, 2002, the entire disclosure of which is hereby incorporated by reference. Referring to FIGS. 16-18, midsole plug 70 is designed to fit inside midsole cavity 72 which is formed in midsole 64. Plug 70 is shaped to mate with the shape of the cavity. As seen in the figures, midsole plug 70 has a complex shape comprising a longitudinal spine 80 with a series of keys 82 extending laterally and in opposing relation from the spine. Each key 82 has a trunk 84 and locking arms 86 extending perpendicularly to the trunk. Locking arms 86 have free ends with locking end surfaces 88 which face the spine. Midsole cavity 72 is shaped with mating features to firmly hold midsole plug in place, particularly when the midsole is loaded with shear forces such as would be experienced with sudden stopping, cutting or change of direction motions of a wearer's foot in the shoe.

Placed between adjacent keys 82 are locking nubs 90 formed integrally with the spine to provide another anti-slip interface between the plug and the midsole 64. Locking nubs may be of any shape, and are shown to be generally hemispherical in the figures.

On the underside of midsole plug 70 and along spine 80 is a downwardly depending longitudinal tongue 92 that is designed to matingly engage longitudinal pleat 74 of the outsole to provide yet another structural element to ensure that the midsole plug stay in place.

The size of the midsole plug determines the width adjustment of the midsole itself. The larger the size, the wider the midsole. Algorithm 300 for calculating the midsole plug size is shown in FIG. 22. First, the Nike Men's Width (NMW) is calculated as follows:

$$NMW = \frac{(W + (9.33 - NMS) * 3.18 - 99.56)}{4.76}$$

The NMW is rounded to the nearest whole size.

Midsole Plug Size=NMW+3

In the present invention, midsole plugs are sized 1, 2, 3, 4, or 5 to correspond to widths B, C, D, E, and EE, respectively.

Employing the preceding formulae, an appropriately sized midsole plug 70 is selected and inserted into midsole 64 to provide one aspect of width adjustment for the shoe. The width adjustment of the shoe upper via the medial/lateral adjustment dial on the adjustable last is achieved using the midsole plug size. Medial/lateral adjustment dial 22 has markings corresponding to the midsole plug sizes 1, 2, 3, 4, or 5. Because the midsole plug size and the medial/lateral adjustment will be the same for a large number of people, those factors being equal is the default adjustment. That is, if midsole plug size 2 is used, the medial/lateral adjustment dial should be set to 2. If the midsole plug size is 3, the medial/lateral adjustment dial should be set to 3, and so forth.

Figure 23:
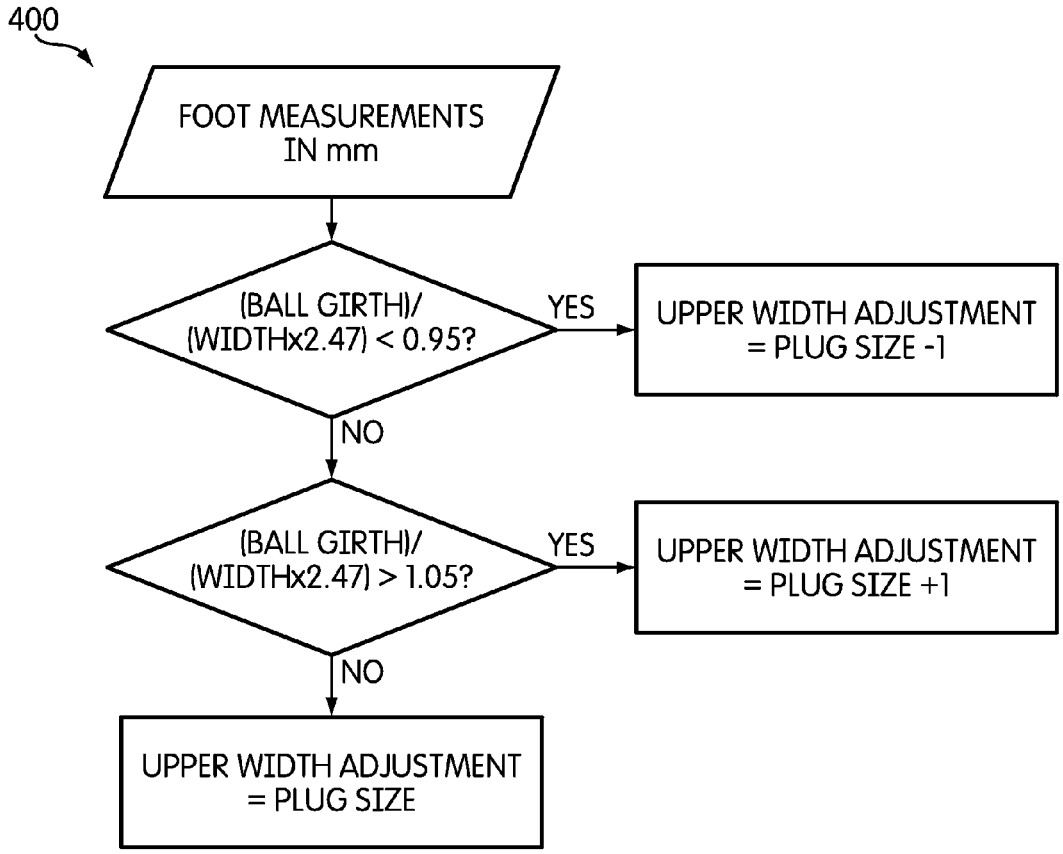
FIG. 23 is a flow diagram showing the width adjustment factor calculation.

However, there are feet which fall outside of this norm, and a comparison of the circumferential ball girth to the linear width provides a useful ratio to determine whether further correction and adjustment are necessary. For example, an individual may have a foot that is wide, but shallow. That is, a relatively small girth measurement compared with a relatively large width measurement. Conversely, an individual may have a foot that is narrow, but deep. That is, a relatively large girth measurement compared with a relatively small width measurement. A ratio of the measured girth to the measured width, in millimeters, is used to determine whether the medial/lateral adjustment dial should be set to be smaller or larger than the calculated midsole plug size. Algorithm 400 for this calculation is shown in FIG. 23, and employs the following formulae to calculate the Upper Width Adjustment Factor (UWAF):

$$\text{If } \left(\frac{BG}{W \times 2.47}\right) < 0.95 \text{ Then } UWAF = \text{Plug Size} - 1$$

$$\text{If } \left(\frac{BG}{W \times 2.47}\right) > 1.05 \text{ Then } UWAF = \text{Plug Size} + 1$$

$$\text{Else, UWAF} = \text{Plug Size}$$

The ball girth and width are dimensions of the foot which intersect the same points on the medial ball and the lateral ball, dimensions 40 and 42 of FIG. 10. Thus, if the ratio of the ball girth to width times 2.47 is within five percent of 1.0, the UWAF is the same as the Plug Size. If the ratio of the girth to width times 2.47 is beyond a five percent tolerance, the UWAF equals the Plug Size plus or minus 1 to provide an additional degree of adjustment.

In the present invention, the adjustment dials are marked with numerical values that correspond to the positions of the mushrooms. For example, dial setting "1" corresponds to the narrowest width with the mushrooms drawn in and abutting body 12. Larger dial setting correspond to incremental positions of the mushrooms extended away from the body. The embodiment described herein includes dial settings 1-5 with setting 5 corresponding to the widest extent that the mushrooms are extended away from body 12.

Figure 24:
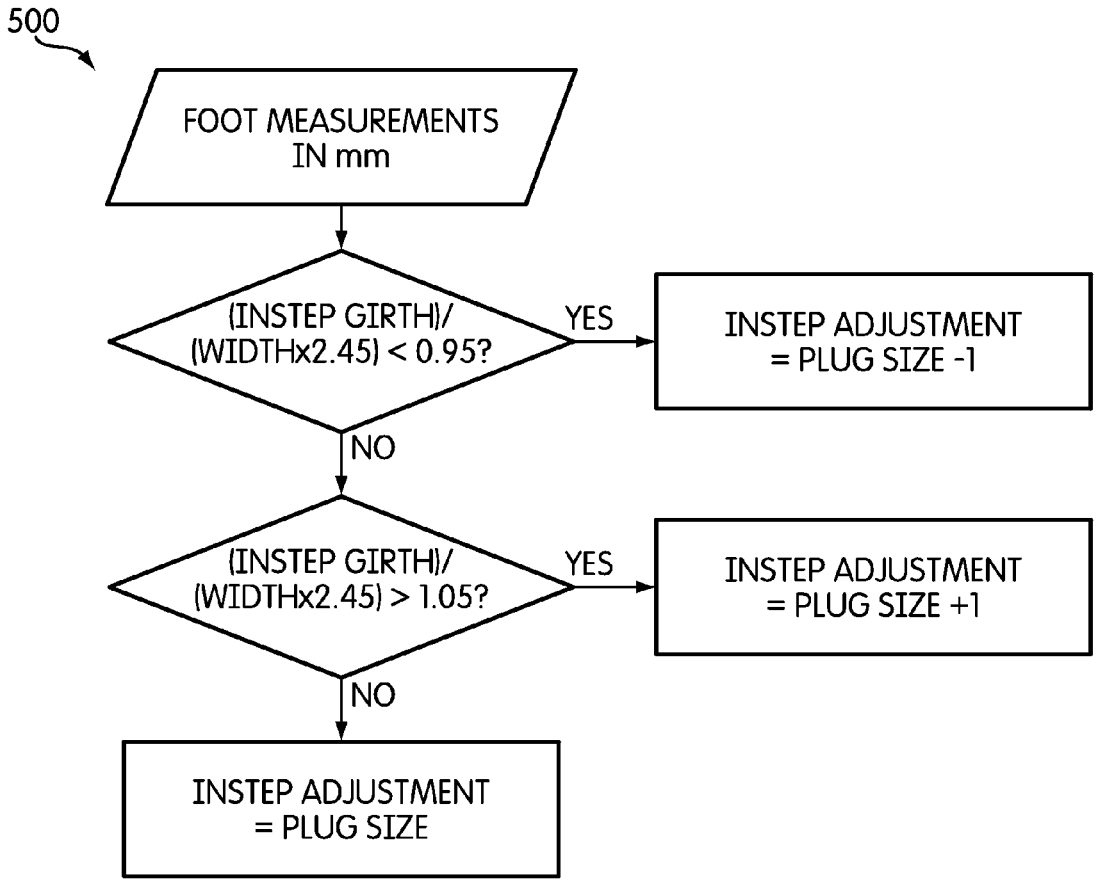
FIG. 24 is a flow diagram showing the instep adjustment factor calculation.

With respect to the two adjustment dials on the adjustable last, for most people, the fit of the shoe will be perfectly fine if the lateral/medial adjustment dial and the instep adjustment dial are set to the same number, corresponding to the midsole plug size. For yet another degree of adjustment, however, the instep adjustment mushroom can also be adjusted independently of the lateral/medial adjustment mushroom. Algorithm 500 for this calculation is shown in FIG. 24 and employs the following formulae to calculate the Instep Adjustment Factor (IAF):

$$\text{If } \left(\frac{IG}{W \times 2.45}\right) < 0.95 \text{ Then } IAF = \text{Plug Size} - 1$$

$$\text{If } \left(\frac{IG}{W \times 2.45}\right) > 1.05 \text{ Then } IAF = \text{Plug Size} + 1$$

$$\text{Else, UWAF} = \text{Plug Size}$$

The instep girth refers to the circumference of the foot at the slimmest portion, and the width refers to the linear measurement from medial ball to lateral ball, dimensions 40 and 44 in FIG. 10. Similar to the UWAF, the IAF refers to the scale on adjustment dial 20 for control over the position of the instep mushroom. The default value of the IAF is the same as the Plug Size as this will provide the right fit for a large number of people. If this finer instep adjustment is used, the adjustment factor comes into play only if the ratio of the instep girth to instep width times 2.45 is beyond five percent of 1.0. Otherwise the IAF is the same as the Plug Size. If the ratio of the instep girth to width times 2.45 is beyond a five percent tolerance, the IAF equals the Plug Size plus or minus 1 to provide another degree of adjustment.

Figure 19:
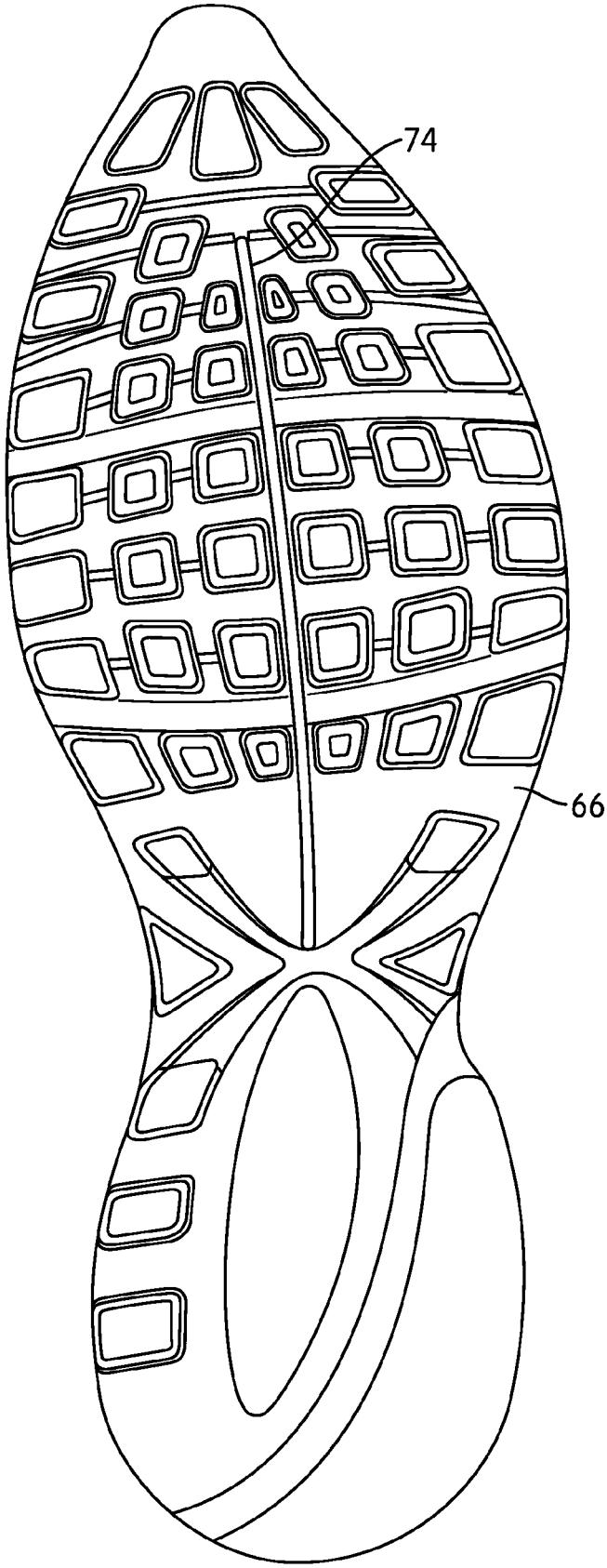
FIG. 19 is a plan view of an adjustable type of outsole.

In conjunction with a midsole allowing width adjustment, the outsole of the shoe must also accommodate width adjustment of the midsole and upper to provide a stable base for the foot. The custom fit shoe in accordance with the present invention employs a longitudinally split and pleated outsole as disclosed in U.S. patent application Ser. No. 10/850,453 filed on May 21, 2004, the entire disclosure of which is also hereby incorporated by reference. An example of a longitudinally split outsole is shown in FIG. 19 showing a tread pattern with a longitudinal split or pleat 74.

Figure 25:
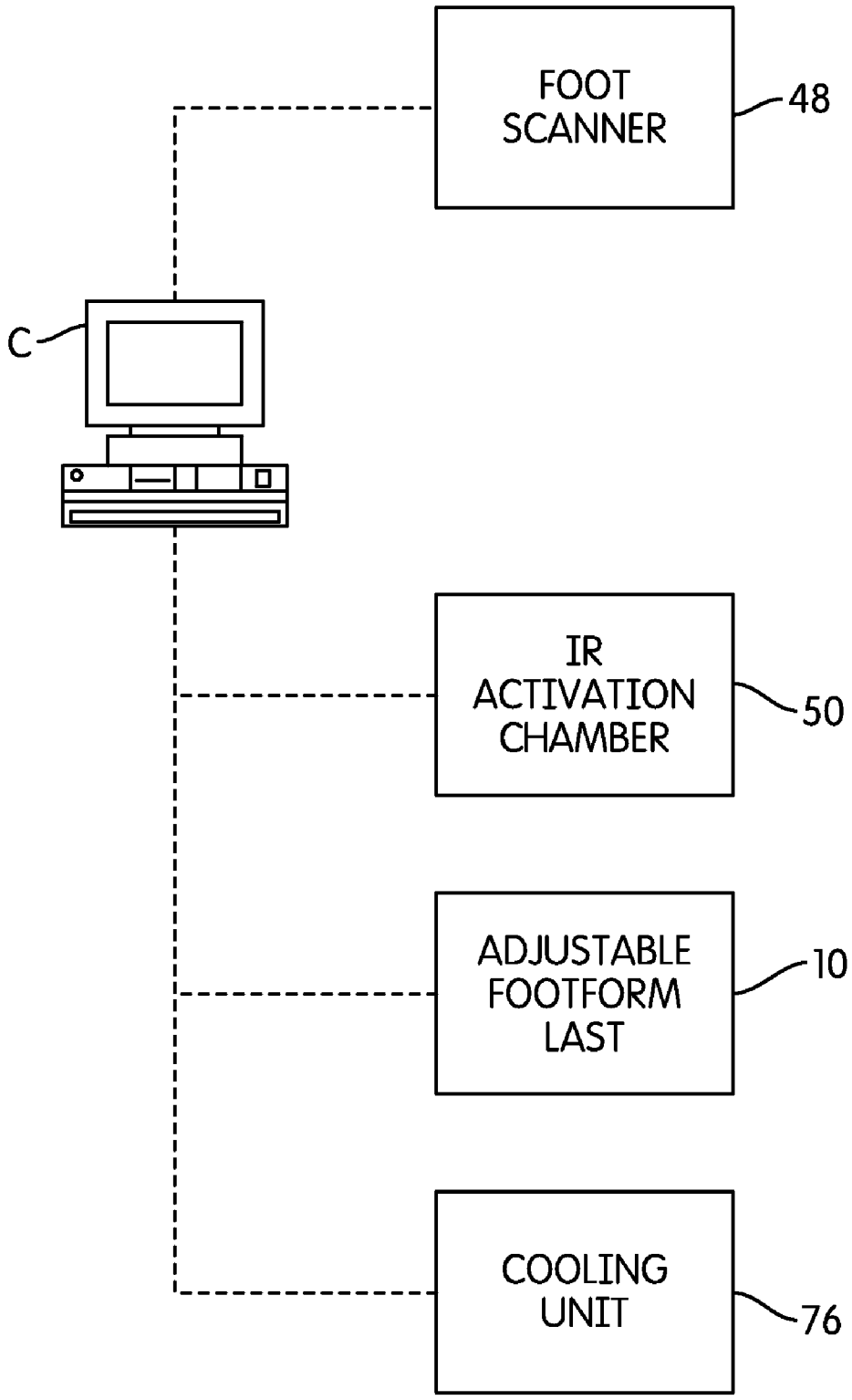
FIG. 25 is a block diagram showing the components of the custom fit system of the present invention.

By way of summary, the main components of the custom fit system are shown schematically in FIG. 25, and include a computer C, foot scanner 48, IR activation chamber 50, adjustable last 10, and optional cooling unit 76. As described above, computer C preferably refers to a separate standalone computer which is connected to foot scanner 48 to gather the foot measurement data. The computer may also be onboard the scanner or any of the other components. The computer stores the measurement data and performs the calculations for size, width, midsole plug size and width and girth adjustments. The calculated results are displayed on the computer's display. It is also within the scope of the invention to connect the other components of the system to the computer. For instance, the IR activation chamber could be connected to the computer so that the heat treatment process including could be entirely or partially computer controlled. Similarly, the adjustable footform last could be designed to be connected directly to the computer and have the adjustments performed automatically. Optional cooling unit 76, discussed below, could also be connected to the computer for automated control over the cooling process. It should also be noted that the term "computer" is intended to encompass a single computer or multiple computers which perform the functions described.

With all of the components described above, the process of custom fitting the shoes will now be described. A separate computer is coupled to the necessary components of the system and performs the following operations: stores the measurement data tagged for the wearer by an identifier, calculates the various sizes and adjustment factors, and displays the calculated results. It is possible to program these functions into the onboard computer of the scanner described above, or any other component of the system.

The identifier and measurement data can also be stored in a database so that repeated purchases by the same wearer can be prepared by employing the stored measurement data instead of having to take the measurements again. Commonly assigned U.S. patent application Ser. No. 09/721,445 filed on Nov. 11, 2000; and U.S. patent application Ser. No. 10/675,237 filed on Sep. 30, 2003, now Publication No. 20050071242, published on Mar. 31, 2005, describe a Method and System for Custom Manufacturing Footwear which employs such a database in the network, and are hereby incorporated by reference in their entireties. The method and system described in those two prior applications could be adapted for use with the adjustable last and system of the present invention.

The following description refers to one foot and one shoe for simplicity, but it will be understood that both feet of the wearer will be subjected to the measurement and/or scanning steps, and that both the left and right shoes will be custom fitted in the same way. The calculations and last and shoe heat treatment are carried out for each shoe.

Figure 20:
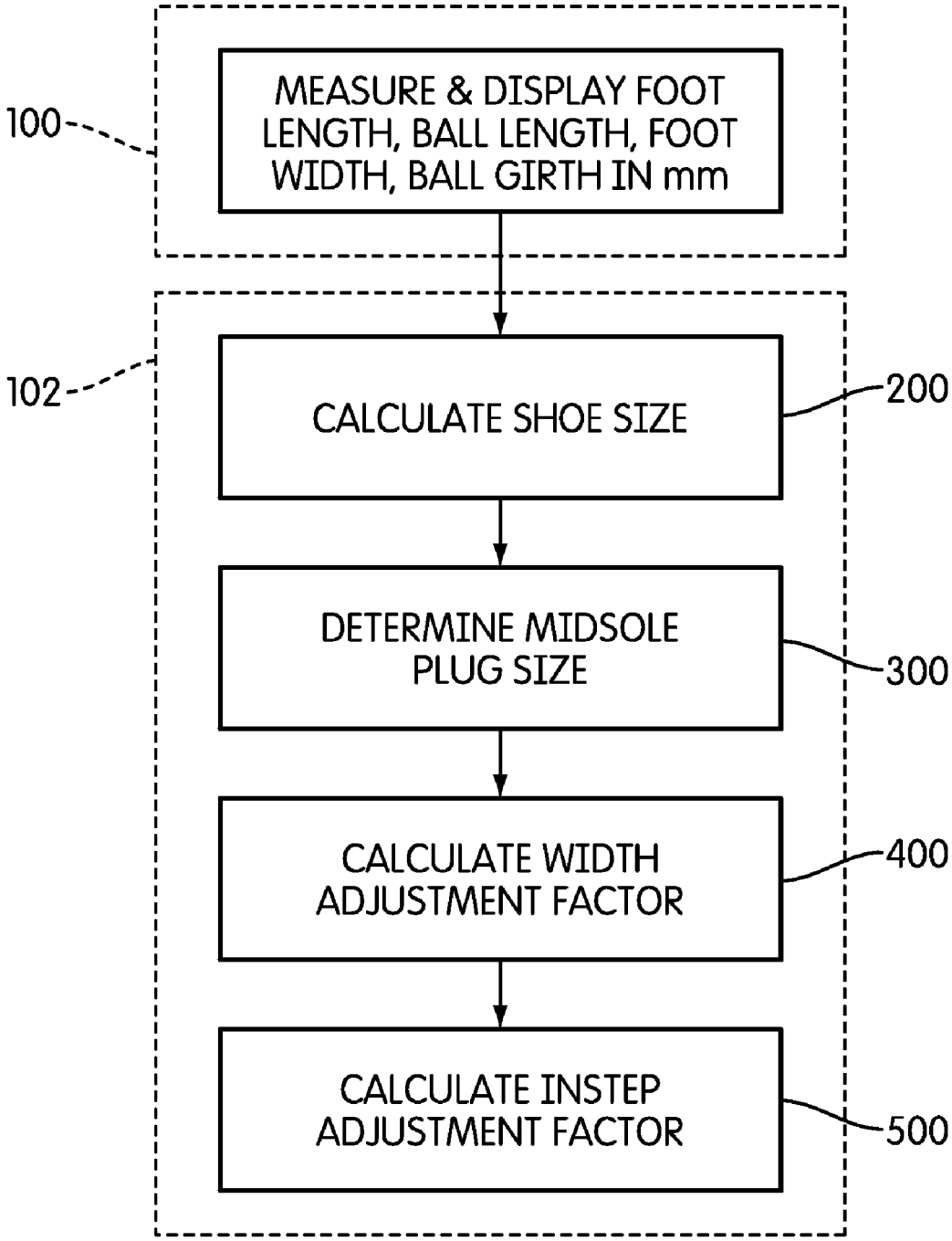
FIG. 20 is a flow diagram showing the measurement and correlation steps of FIG. 9.
Figure 21:
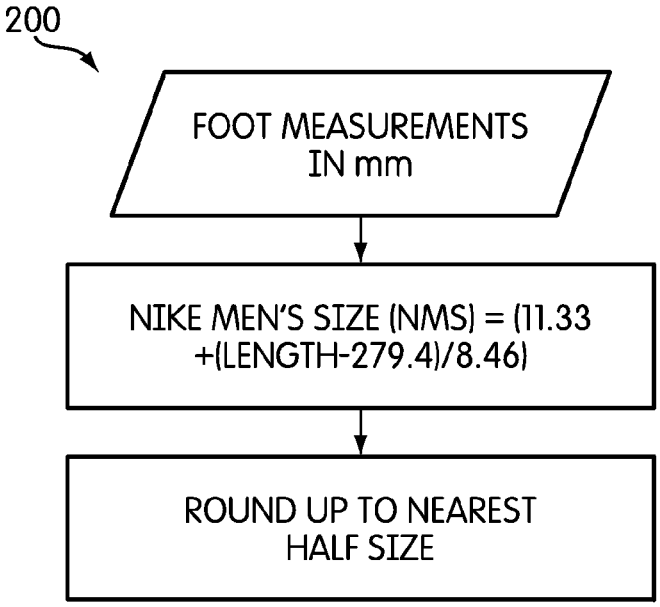
FIG. 21 is a flow diagram showing the shoe size calculation subroutine.

Referring again to FIG. 9 which provides an overview of the entire method, the first step is to measure the foot to gather the raw measurement data in millimeters. At least the dimensions shown in FIG. 10 will be gathered either by a linear measurement tool or by a scanner, step 100, FIGS. 9 and 20. The measurement data is stored in the computer and tagged by an identifier such as the wearer's name or other identifier. The computer then uses the measurement data to calculate the Midsole Plug Size and last settings, step 102, in accordance with the subroutines detailed in algorithms 200, 300, 400 and 500 shown in FIGS. 20-24. Once the Shoe Size, Midsole Plug Size, the UWAF and the IAF are calculated, the properly sized midsole plug is inserted into the midsole of the shoe, step 104. Then the shoe is fitted onto adjustable last 10, step 106.

The shoe and last are then placed inside the infrared activation chamber, step 108. As described previously, the shoe and the chamber have mating RF ID tags to ensure that the chamber can only be activated with the appropriate shoes are placed within the chamber. Again, the chamber may have another physical safeguard such as a switch on the platform to ensure that the infrared radiation cannot be activated without a proper shoe and last in place. The shoe and last are then heat treated inside the infrared activation chamber, step 110. In this step the activation zones of the shoe are heat treated until they are plastic. After some time lapse, the adjustment dials of the last are adjusted according to the calculations for the width and girth. The shoe with the adjusted last is heat set to the size that the adjustable last allows. Thus, in this embodiment, the shoe is stretched to fit. The exact time of exposure to infrared radiation in the chamber depends upon a number of factors such as the material used for the activation zones, the sizes of the activation zones relative to the entire upper, etc. For the shoe shown in FIG. 15, the activation chamber is set for a two minute ramp-up phase after which the dials of the last are adjusted, and a two minute heat-treatment phase. The chamber shuts off automatically at the end of the heat treatment cycle. This can be controlled by a simple timer mechanism, or can be controlled by the computer which is coupled to the switch on the activation chamber. In one mode, an indicator light is supplied to the activation chamber and is lit after the ramp-up phase to indicate that the adjustment dials on the last should be moved. In another mode, the computer display may indicate when the dials should be set. It would be possible to automate these steps by operatively coupling the adjustment dials of the last to the computer so that the calculated values are output as voltage to a servo that automatically adjusts the dials at an optimal time during heat treatment.

As described above the preferred material for the activation zones of the shoe is a polyester spacer mesh, and the exact settings for the radiation cycle will depend on the melting point of the material. In the embodiment described herein, the infrared radiation cycle of the first heat treatment which can be referred to as the ramp up time lasts approximately two minutes and brings the temperature in the activation area to between 280° to 360° F. The second treatment which can be referred to as the soak or hold period lasts approximately two minutes with the temperature held steady between 280° and 360° F. After the soak or hold period, there is generally a 30 second window to set the calibration mechanisms to the desired settings. The IR radiation is then turned off, and the shoes are left inside the chamber for about one minute to cool them sufficiently to safely handle them.

After heat treatment, the shoe and last are removed from the activation chamber and allowed to cool, step 112. At room temperature, the shoe and last should cool for at least twenty minutes. To speed up the cooling process, the shoe and last could be placed in the path of a fan or fans, or in a refrigeration unit 76, FIG. 25, set for 32° to 42° F. At these refrigerated temperatures, the cooling step would only take two to five minutes. For marketing effect the refrigeration unit preferably has a glass front to display the just-completed shoes and emphasize customization of the shoes as they cool.

After cooling, whether by fan, refrigeration or sitting at room temperature, the shoe is removed from the last, step 116, and sizing is completed, step 118. The completed shoe is custom fitted to the wearer's foot based on the measurements made only a few minutes earlier. If the wearer finds that the shoe does not fit as desired, the process can be run again to retreat the shoe. In this embodiment, since the shoe upper is being stretched to fit, if the wearer's foot straddles two width sizes, the first time the process is run, the smaller of the two widths should be used. If after the first run, the shoe fits too snugly, it can be stretched further to the next width size up. Of course, if the shoes were designed so that heat treatment is used to shrink the shoes to fit, this would be done in reverse. That is, the first iteration would be to a wider width so that if the fit were too loose, a second iteration could be performed to shrink the shoe to the next width size down.

In this manner the present custom fit system provides quick customization. The fit accomplished by the present system and method is one that heretofore could only be obtained by ordering custom made shoes made on a custom made last. A process that was not only time consuming, but too expensive for the mass produced market.

The steps of the custom fit method may be performed in a single location or multiple locations. For a single location, it is most likely to be a retail location with all of the equipment available where a buyer can have his/her feet scanned and wait for the customized shoes to purchase. For multiple locations, there are a number of variations. One possibility is to carry out the foot scanning steps in a first location such as a retail location, and then have the foot measurement data transmitted to a second location where the shoes are actually selected, lasted on an adjustable footform last and then treated in an activation chamber. This second location could be a manufacturing or distribution location. The finished shoes could be sent directly to the wearer or back to the retail location for pick-up. Another variation would be to have a wearer obtain their foot dimension data on their own at home or another private location, and have the data transmitted to second location to have the shoes completed. A simple example of this scenario is to have a wearer use a manual measurement device, and then communicate the data by telephone, fax or mail order. A more sophisticated example would be having this exchange of data occur between computers in a network or the internet, in which case a system and method for sizing footwear over a computer network as disclosed in U.S. Pat. No. 6,879,945 may be employed. U.S. Pat. No. 6,879,945 is hereby incorporated by reference in its entirety.

It will be understood by those skilled in the art that the software for performing the various calculations disclosed herein can be contained in the separate computer which is disclosed in the description, or in the scanner's onboard computer. A separate computer may be preferred to control all aspects of the process and to provide an independent database for storing the measurement data taken. In addition, a separate computer will provide more options for displaying the various steps of the method and the resulting calculations. A separate computer will also provide more inputs and outputs to automate some or all steps of the process described herein.

Referring again to the adjustable last, in addition to the medial, lateral and instep mushrooms illustrated in the figures, it would be possible to design the adjustable last with additional adjustment mushrooms. For example, to accommodate a particular foot geometry or anatomical feature such as bunion, the adjustable last could be designed with an additional mushroom to provide the space in the finished shoe for the individual's foot. To carry the example further, since many people have a prominent bunion on the medial side of the foot, the adjustable last could be designed to have an additional metatarsal mushroom on the medial side to accommodate bunions. Other examples of additional mushrooms are a toe cap mushroom to square the toe area, and a heel mushroom to adjust the heel width. Combinations of additional mushrooms are also within the purview of the present invention. Broadly, this is simply referred to as an additional mushroom since any number could be designed onto the last at any number of points to provide additional adjustment parameters.

The description of the invention heretofore focuses on the custom fit aspect of the invention. Another application of the principles of the present invention is in producing athletic shoes of a custom size for a particular activity such as running, basketball or tennis. Athletic shoes are generally designed for a particular activity or category. Many manufacturers use different shoe lasts for different categories of shoes as the activities dictate to a large extent the desired fit on the wearer's foot. The main components of the system and the method steps of the invention remain generally the same as those described above when customizing for a category, with the main difference being in the adjustable last itself. The adjustable last can be thought of broadly as a chassis with interchangeable mushrooms to provide a custom fit. The mushrooms can be designed to provide a particular shape or geometry to the portion of the shoe being affected by the last in addition to the sizing aspect. A single last body can be fitted with different mushrooms to account for the different geometries of a category of shoes. For example, a single last body may be used with one set of mushrooms to produce a running shoe, and a second set of mushrooms to produce a basketball shoe. Expanding the use of the inventive system and method in this manner would decrease the inventory needs of the system. Instead of having to provide a set of last bodies for each category of shoe, a single set of last bodies could be used with different sets of adjustment mushrooms.

While various embodiments of the invention have been described, it will be apparent to those of ordinary skill in the art that may more embodiments and implementations are possible that are within the scope of the invention.

What is claimed is:

1. A system for custom fitting shoes comprising:

an adjustable last adapted to be inserted into a shoe with an upper comprising a typical material surrounding one or more activation zones made of a heat malleable material, said last comprising a last body, and medial and lateral adjustment elements movably affixed to said last body and movable toward and away from said last body to provide custom width sizing; and an infrared activation chamber adapted to receive and heat treat the shoe fitted onto said adjustable last until the one or more activation zones are plastic and to set the heat malleable material to fix the width of the shoe.

2. The system of claim 1, further comprising a foot measurement device to measure a wearer's foot.

3. The system of claim 2, wherein said foot measurement device is a foot scanner.

4. The system of claim 2, further comprising a computer for correlating foot measurements to adjustment settings on said adjustable last by calculating adjustment factors.

5. The system of claim 1, wherein said infrared activation chamber comprises a plurality of infrared lamps positioned about a target area.

6. The system of claim 5, wherein said infrared activation chamber comprises a safeguard preventing activation of the chamber without an appropriately designed shoe positioned in the target area.

7. The system of claim 6, wherein said safeguard is a radiofrequency ID transceiver.

8. The system of claim 6, wherein said safeguard is a detent on said adjustable last and a mating switch on said activation chamber.

9. The system of claim 1, further comprising a cooling unit.

10. The system of claim 4, wherein said computer is connected to said foot measurement device to obtain and store foot dimension data, calculate adjustment factors and display adjustment factors.

11. The system of claim 10, wherein said computer is connected to said IR activation chamber and controls the heat treatment cycles.

12. The system of claim 10, wherein said computer is connected to said adjustable last to automatically adjust said last in accordance with calculated adjustment factors.

13. A system for custom fitting shoes comprising:

an adjustable last adapted to be inserted into a shoe with an upper having activation zones made of a heat malleable material, said last comprising a last body, and medial and lateral adjustment elements movably affixed to said last body and movable toward and away from said last body to provide custom width sizing;

an infrared activation chamber adapted to receive and heat treat the shoe fitted onto said adjustable last until the activations zones are plastic and to set the heat malleable material to fix the width of the shoe;

a foot scanner adapted to auto-detect reference points of a foot and gather foot measurement data; and a computer connected to said foot scanner for correlating foot measurement data to adjustment settings on said adjustable last by calculating adjustment factors, the adjustment factors including at least a midsole plug size to provide width adjustment to a midsole of the shoe.

14. The system of claim 13, wherein said computer is also connected to said IR activation chamber and controls the heat treatment cycles.

15. The system of claim 13, wherein said computer is also connected to said adjustable last to automatically adjust said last in accordance with calculated adjustment factors.

16. A system for custom fitting shoes comprising:

an adjustable last adapted to be inserted into a shoe with an upper constructed at least in part of a first material and one or more activation zones made of a second material that is different from said first material, said last comprising a last body, and medial and lateral adjustment elements movably affixed to said last body and movable toward and away from said last body to provide custom width sizing; and an activation chamber adapted to receive and treat the shoe fitted onto said adjustable last until the second material in the activation zones are plastic and to set the second material to fix the width of the shoe.

17. The system of claim 16, further comprising a foot measurement device to measure a wearer's foot.

18. The system of claim 17, wherein said foot measurement device is a foot scanner.

19. The system of claim 17, further comprising a computer for calculating a shoe length size, a shoe width size and adjustment factors from foot measurements and correlating to adjustment settings on said adjustable last.

20. The system of claim 16, wherein said activation chamber is an infrared activation chamber comprising a plurality of infrared lamps positioned around a target area.

21. The system of claim 20, wherein said activation chamber comprises a safeguard preventing activation of the chamber without an appropriately designed shoe positioned in the target area.

22. The system of claim 21, wherein said safeguard is a radiofrequency ID transceiver.

23. The system of claim 21, wherein said safeguard is a detent on said adjustable last and a mating switch on said chamber.

24. The system of claim 20, further comprising a cooling unit.

25. The system of claim 19, wherein said computer is connected to said foot measurement device to obtain and store foot dimension data, calculate adjustment factors and display adjustment factors.

26. The system of claim 25, wherein said computer is connected to said activation chamber and controls the treatment cycles.

27. The system of claim 25, wherein said computer is connected to said adjustable last to automatically adjust said last in accordance with calculated adjustment factors.

28. A system for custom fitting shoes comprising:

a foot measurement device configured to measure foot measurement data associated with a foot of a wearer;

a database for storing the foot measurement data;

wherein the database includes an identifier for associating the foot measurement data to a particular wearer;

a first computer in communication with the database, the first computer calculating at least a shoe length size, a shoe width and an adjustment factor based on the foot measurement data, wherein calculating the shoe width includes calculating a midsole plug size to provide width adjustment to a midsole of a shoe;

wherein the first computer correlates the calculated shoe length size, shoe width and adjustment factor to a last; and wherein a first location uses the last to custom fit a first pair of shoes to the foot measurement data of the particular wearer.

29. The system of claim 28, wherein the first computer correlates the calculated shoe length size, shoe width and adjustment factor to a plurality of adjustment settings for an adjustable last.

30. The system of claim 28, further comprising a second location that custom fits a second pair of shoes to the foot measurement data of the particular wearer.

31. The system of claim 30, wherein the first location and the second location are the same.

32. The system of claim 30, the second location further comprising a second computer having access to the database to retrieve the stored foot measurement data for the particular wearer; and wherein the second location uses the second computer to calculate at least a shoe length size, a shoe width and an adjustment factor for the second pair of shoes based on the stored foot measurement data.

33. The system of claim 32, wherein the first location and the second location are different locations.

34. The system of claim 28, wherein the identifier comprises a user name; and wherein the database is accessible through the internet.

35. The system of claim 28, the database further comprising fit assessment data associated with the identifier of the particular wearer.

36. The system of claim 35, wherein the fit assessment data further includes at least a length fit assessment and a width fit assessment correlated to a previous pair of shoes of the particular wearer.

37. The system of claim 36, wherein the previous pair of shoes is the first pair of shoes.

38. A method for custom fitting an article of footwear, the method comprising:

receiving a plurality of foot measurement parameters associated with a foot of a wearer;

storing the plurality of foot measurement parameters in a database;

associating the plurality of foot measurement parameters with a particular wearer using an identifier;

accessing the database using a computer to retrieve the plurality of foot measurement parameters for the particular wearer;

calculating at least a shoe length size, a shoe width and an adjustment factor based on the plurality of foot measurement parameters, wherein calculating the shoe width includes calculating a midsole plug size to provide width adjustment to a midsole;

correlating the calculated shoe length size, shoe width and adjustment factor to a last; and custom fitting a first article of footwear to the plurality of foot measurement parameters of the particular wearer using the last.

39. The method of claim 38, wherein the first article of footwear comprises an upper constructed at least in part of treatable material in activation zones; and wherein the step of custom fitting the first article of footwear further comprises using an activation chamber to receive and treat the first article fitted onto said last until the activation zones are plastic and to set the treatable material to fix the shoe width size.

40. The method of claim 38, wherein a foot scanner is configured to auto-detect reference points of a foot and determine the plurality of foot measurement parameters of the particular wearer.

41. The method of claim 38, further comprising custom fitting a second article of footwear to the plurality of foot measurement parameters of the particular wearer.

42. The method of claim 41, wherein the second article of footwear is a different shoe model than the first article of footwear.

43. The method of claim 41, wherein the step of custom fitting the first article of footwear is performed at a first location; and wherein the step of custom fitting the second article of footwear is performed at a second location, the second location being different than the first location.

44. The method of claim 41, wherein the step of custom fitting the second article of footwear further comprises:

accessing the database to retrieve the plurality of stored foot measurement parameters for the particular wearer; and calculating at least a second shoe length size, a second shoe width and a second adjustment factor for the second article of footwear based on the plurality of stored foot measurement parameters.

45. The method of claim 38, wherein the identifier comprises a user name; and wherein the database is accessible through the internet.

46. The method of claim 38, further comprising:

storing fit assessment data in the database; and associating the fit assessment data with the identifier of the particular wearer.

47. The system of claim 46, wherein the fit assessment data further includes at least a length fit assessment and a width fit assessment correlated to a previous article of footwear of the particular wearer.

48. The system of claim 47, wherein the previous article of footwear is the first article of footwear.

49. A system for custom fitting shoes comprising:

a first computer for receiving foot measurement data associated with a foot of a wearer;

a database in communication with the first computer for storing the foot measurement data;

wherein the database includes an identifier for associating the foot measurement data to a particular wearer;

a second computer in communication with the database, the second computer calculating at least a shoe length size, a shoe width and an adjustment factor based on the foot measurement data, wherein calculating the shoe width includes calculating a midsole plug size to provide width adjustment to a midsole;

wherein the second computer correlates the calculated shoe length size, shoe width and adjustment factor to a portion of an upper and a portion of a sole unit including the midsole; and wherein a first location uses the correlated upper and sole unit to custom fit a first pair of shoes to the foot measurement data of the particular wearer.

50. The system of claim 49, further comprising a second location that custom fits a second pair of shoes to the foot measurement data of the particular wearer.

51. The system of claim 50, wherein the first location and the second location are the same.

52. The system of claim 50, the second location further comprising a third computer having access to the database to retrieve the stored foot measurement data for the particular wearer; and wherein the second location uses the third computer to calculate at least a shoe length size, a shoe width and an adjustment factor for the second pair of shoes based on the stored foot measurement data.

53. The system of claim 52, wherein the first location and the second location are different locations.

54. The system of claim 49, wherein the identifier comprises a user name; and wherein the database is accessible through the internet.

55. The system of claim 49, the database further comprising fit assessment data associated with the identifier of the particular wearer.

56. The system of claim 55, wherein the fit assessment data further includes at least a length fit assessment and a width fit assessment correlated to a previous pair of shoes of the particular wearer.

57. The system of claim 56, wherein the previous pair of shoes is the first pair of shoes.

58. The system of claim 49, the database further comprising shoe characteristics associated with the identifier of the particular wearer.

59. The system of claim 58, wherein the shoe characteristics comprise one or more of structural selections, color selections, and personalization.

60. The system of claim 59, wherein the first location further uses one or more shoe characteristics associated the identifier of the particular wearer to assemble the first pair of shoes.

* * * * *